US008626030B2

(12) United States Patent
Adachi

(10) Patent No.: US 8,626,030 B2
(45) Date of Patent: Jan. 7, 2014

(54) CHARGING DEVICE HAVING DISCHARGE ELECTRODE AND, IMAGE FORMING APPARATUS COMPRISING CHARGING DEVICE, AND METHOD FOR FORMING DISCHARGE ELECTRODE

(75) Inventor: Katsumi Adachi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 440 days.

(21) Appl. No.: 12/915,607

(22) Filed: Oct. 29, 2010

(65) Prior Publication Data

US 2011/0103836 A1 May 5, 2011

(30) Foreign Application Priority Data

Oct. 29, 2009 (JP) ..... P2009-249504

(51) Int. Cl.
*G03G 15/02* (2006.01)

(52) U.S. Cl.
USPC ..... 399/173

(58) Field of Classification Search
USPC ..... 399/170–173; 250/324–326
See application file for complete search history.

(56) References Cited

U.S. PATENT DOCUMENTS

| | | | |
|---|---|---|---|
| 5,367,366 A | 11/1994 | Kido et al. | |
| 5,466,938 A | 11/1995 | Nakayama et al. | |

FOREIGN PATENT DOCUMENTS

| | | | |
|---|---|---|---|
| JP | 05-002314 | | 1/1993 |
| JP | 06-011946 | | 1/1994 |
| JP | 07-104549 | | 4/1995 |
| JP | 7-146600 A | | 6/1995 |
| JP | 08078135 A | * | 3/1996 |
| JP | 08137200 A | * | 5/1996 |
| JP | 08-160711 | | 6/1996 |
| JP | 11-212335 | | 8/1999 |

* cited by examiner

*Primary Examiner* — Walter L Lindsay, Jr.
*Assistant Examiner* — Milton Gonzalez
(74) *Attorney, Agent, or Firm* — Nixon & Vanderhye P.C.

(57) ABSTRACT

A charging device capable of improvement in charging uniformity on an object to be charged, an image forming apparatus having the charging device, and a discharge electrode forming method are provided. The charging device has a discharge electrode which is disposed in an interior space of a shield case, has a plurality of projections aligned in one direction from which a stream of ions is generated, the projections each being so constituted that a widthwise direction thereof makes a predetermined angle with respect to a first imaginary plane including an arrangement direction C of the projections on a second imaginary plane which includes the arrangement direction C and is perpendicular to the first imaginary plane in order that streams of ions generated from the projections that are arranged adjacent to each other in a lengthwise direction of the shield case can overlap each other when viewed in a widthwise direction of the shield case.

10 Claims, 12 Drawing Sheets

CHARGING DEVICE HAVING DISCHARGE ELECTRODE AND, IMAGE FORMING APPARATUS COMPRISING CHARGING DEVICE, AND METHOD FOR FORMING DISCHARGE ELECTRODE

CROSS-REFERENCE TO RELATED APPLICATION

This application claims priority to Japanese Patent Application No. 2009-249504, which was filed on Oct. 29, 2009, the content of which is incorporated herein by reference in its entirety.

BACKGROUND OF THE INVENTION

1. Field of the Invention

The present invention relates to a charging device of corona discharge type, an image forming apparatus comprising the charging device, and a method for forming a discharge electrode.

2. Description of the Related Art

Heretofore, in an image forming apparatus which employs an electrophotographic system, a charging device of corona discharge type (corona discharge device) has commonly been used for a charging device for charging a photoreceptor, a transfer device for effecting electrostatic transfer printing of a toner image to a recording paper sheet, a separating device for effecting electrostatic separation of a recording sheet, and so forth.

As a corona discharge device, there is known a corona discharge device of so-called corotron type, which comprises a shield case having an opening formed to face an object to be charged such as a photoreceptor or a recording paper sheet, and a discharge electrode disposed in the interior space of the shield case. In the corotron-type corona discharge device, upon application of a high voltage, corona discharge takes place at the discharge electrode. A stream of ions generated through the corona discharge travels toward an object to be charged so as to generate a discharge current, with the consequence that an object to be charged is brought into a charged state.

As another corona discharge device, there is known a corona discharge device of so-called scorotron type, which is constructed by adding a grid electrode to the structure of the corotron-type corona discharge device. The grid electrode is disposed between a discharge electrode and an object to be charged. In the scorotron-type corona discharge device, a voltage of predetermined level is applied to the grid electrode at the time of corona discharge, so that an object to be charged can be charged even more uniformly. However, in the corona discharge devices of corotron type and scorotron type, there is a need to pass a large quantity of discharge current to bring electric discharge into a condition of stability, which gives rise to the problem of generation of large amounts of ozone.

As a charging device other than the corona discharge device, there is known a contact-type charging device having a charging member formed of a semiconducting roller or brush. In this construction, the charging member is brought into contact with or placed proximately to face an object to be charged, and a voltage is applied between the charging member and the object to be charged, so that the object to be charged can be charged. According to the contact-type charging device, the region of electric discharge is limited to a minute gap created in the vicinity of the part of contact between an object to be charged and the charging member. Therefore, in the contact-type charging device, in contrast to the corona discharge device, the amount of discharge current can be reduced. Accordingly, the contact-type charging device is capable of reduction in the amount of ozone generation.

However, the contact-type charging device poses the following problems. The charging member is prone to abrasion and quality degradation due to the contact with an object to be charged, electrical stress, and so forth, which makes it difficult to achieve speeding-up of a charging process, as well as to impart a long operable life to the charging member. Furthermore, the charging characteristics of the contact-type charging device are likely to deteriorate due to changes in the properties of the charging member ascribable to contamination, environmental conditions, a lapse of time, and so forth.

In addition to that, a technology to achieve superimposition of multi-color images on a photoreceptor (called IOI: Image On Image) has been developed in recent times. The IOI technology affords the advantages of being less prone to displacements of images of a plurality of colors and of causing little image quality deterioration because of just one time of a transfer process being required, and is therefore excellent in production of high-quality images. However, the IOI technology is not adapted to the use of a contact-type charging device. Accordingly, the IOI technology necessitates a non-contact type charging device which exhibits high charging uniformity.

In view of such circumstances, in the design of corona discharge devices of corotron type, scorotron type, etc. attempts have been made to achieve a reduction in the amount of ozone generation, an increase in longevity, improvement in charging characteristics, and so forth.

In Japanese Unexamined Patent Publication JP-A 6-11946 (1994), there is disclosed a charging device built as a corona discharge device having a discharge electrode of serrated configuration. In the corona discharge device having, like the discharge electrode of serrated configuration, a discharge electrode having sharp-pointed projections, an electric field tends to be concentrated on the projections, and also the number of electric discharge points is reduced. Accordingly, even if the level of a voltage to be applied is relatively low, it is possible to effect corona discharge, wherefore generation of ozone can be suppressed.

However, in the corona discharge device equipped with a discharge electrode having projections, variations in the state of electric discharge are caused by abrasion of the projections, adhesion of discharge products, and so forth. This leads to unevenness in the charged potential of an object to be charged in the direction of the length of the corona discharge device, with the consequent possibility that the charging uniformity of an object to be charged will be impaired. In the event of, for example, abrasion of the projections, in order to prevent impairment of the charging uniformity, as a condition for voltage application, the level of a voltage to be applied is set to be higher than normal so that required discharge current can be generated even at the projection in a state where electric discharge is less likely to occur. However, an increase in the level of an applied voltage results in excessive electric discharge at the projection in a state where electric discharge occurs readily. This leads to occurrence of unnecessary electric discharge that does not contribute to charging of an object to be charged, with a consequent undesirable increase in the amount of ozone generation.

As a technique to overcome such a problem, in Japanese Unexamined Patent Publications JP-A 5-2314 (1993) and JP-A 8-160711 (1996), there is disclosed a technology to divide a discharge electrode of serrated configuration into pieces on a projection-by-projection basis so as to connect an electric resistor element between each of the projections and a power source. In such a structure, in the projection where the amount of discharge current is large, a drop in voltage caused by the connected electric resistor element is significant, and the applied voltage is decreased correspondingly, wherefore corona discharge is restricted. On the other hand, in the projection where the amount of discharge current is small, a drop in voltage caused by the connected electric resistor element is insignificant, and the applied voltage is increased correspondingly, wherefore corona discharge is accelerated. Thus, according to the technology presented in JP-A 5-2314 and JP-A 8-160711, variations in a stream of ions among the projections can be reduced, with the consequent improvement in charging uniformity. Moreover, since satisfactory charging uniformity can be attained even if the applied voltage is decreased to reduce the total amount of discharge current, it is possible to reduce the amount of ozone generation. It is noted that, however, the manufacturing cost will be increased because of the necessity for providing an electric resistor element in the corona discharge device.

In Japanese Unexamined Patent Publication JP-A 7-104549 (1995), there is disclosed a technology to achieve improvement in charging uniformity in a scorotron-type discharge device by reducing the aperture ratio of a grid electrode opposed to a tip end portion of a discharge electrode, viz., a discharge region, so that part of a stream of ions can be absorbed by the grid electrode. According to the technology presented in JP-A 7-104549, improvement in charging uniformity can be achieved in a simple manner with low cost. However, the negative side is that, as a stream of ions traveling toward an object to be charged is absorbed by the grid electrode, there will be a drop in the charged potential of an object to be charged correspondingly.

In Japanese Unexamined Patent Publication JP-A 11-212335 (1999), there is disclosed a charging device comprising an electric field regulation member to eliminate a ripple in charged potential, as will hereinafter be described. A paragraph [0026] of JP-A 11-212335 states that the pitch of projections of a discharge electrode should preferably be increased to achieve reduction in the amount of ozone generation and improvement in the charging uniformity of an object to be charged as well. In order to verify this suggestion, an electric discharge test was performed on each of a case under a condition where the pitch of projections of a discharge electrode is narrow and a case under a condition where the pitch of the projections thereof is wide. The measurement of a charged potential at an object to be charged has been carried out by means of an experiment system as shown in FIG. 2 that will hereinafter be described. In a corona discharge device having no grid electrode (corotron), discharge electrodes of varying projection pitch were mounted individually. Upon charging a photoreceptor, a charged potential on the surface of the photoreceptor was measured in a direction along the length of the photoreceptor.

FIGS. 8A to 8D are views showing a relationship between a projection pitch in a discharge electrode and charging uniformity. As to the condition where the projection pitch of a discharge electrode A1 is narrow as shown in FIG. 8A, as shown in FIG. 8B, irregular fluctuations were observed in the charged potential of the photoreceptor. Furthermore, as the result of observation of the projections of the discharge electrode A1 under this condition, as shown in FIG. 8A, it has been found that, among the projections, some undergo light emission A2 resulting from electric discharge, but others don't, with consequent lack of uniformity in the state of electric discharge. Thus, when the state of electric discharge is not uniform, although it is possible to attain at least practically acceptable charging uniformity by, as has already been described, increasing discharge current or by providing a narrow grid electrode as presented in JP-A 8-160711, unnecessary electric discharge has to be conducted. This leads to an increase in the amount of ozone generation as is undesirable.

On the other hand, as to the condition where the projection pitch of the discharge electrode A1 is wide as shown in FIG. 8C, as shown in FIG. 8D, a ripple took place in the charged potential. However, this is not irregular fluctuations but regular periodic fluctuations that occur at intervals substantially equivalent to the pitch distance between the projections. Moreover, as the result of observation of the state of light emission during electric discharge, as shown in FIG. 8C, it has been found that each and every projection undergoes light emission A2 resulting from electric discharge and that electric discharge takes place at each and every projection in a relatively stable condition. Further, a comparison was made between the case under the condition where the pitch is narrow and the case under the condition where the pitch is wide in respect of the amount of ozone generation. At this time, the amount of discharge current for the former case and that for the latter case were set at the same value. The result is that the case under the condition where the pitch is wide yielded a reduction in the amount of ozone generation. It is noted that, however, it was found to be difficult to eliminate the ripple occurring in the charged potential under the condition where the pitch is wide in spite of the provision of a grid electrode.

In this regard, according to the JP-A 11-212335, with the provision of an electric field regulation member between a tip end portion of the discharge electrode and another tip end portion adjacent thereto, a stream of ions coming from the projection can be deflected in the direction of the length of an object to be charged. This makes it possible to achieve improvement in charging uniformity, and further achieve both reduction in the amount of ozone generation and improvement in charging uniformity at one time.

However, even if the charging device presented in JP-A 11-212335 is adopted for use, there still remains unevenness in charged potential. This problem will be described hereinbelow.

At first, an electric discharge test was conducted with use of a conventional corona discharge device. FIGS. 9A to 9C are views showing how electric discharge is to be effected in the conventional corona discharge device. The conventional corona discharge device is a scorotron-type corona discharge device having stylus electrodes H arranged at regular intervals. Instead of a grid electrode, a counter electrode T for permitting arrival of a stream of ions generated is disposed at a location spaced a predetermined distance away from the tip end of the stylus electrode H. With this construction, an electric discharge test was conducted. At that point in time when dozens of hours have elapsed since the start of the electric discharge test, as shown in FIG. 9B, elliptical traces of demarcations of ion streams were observed on a surface of the counter electrode T. As will be understood from the demarcation traces of ion streams, as shown in FIG. 9A, a stream of ions is readily diffused in a direction perpendicular to the direction of arrangement of the stylus electrodes H. However, as shown in FIG. 9C, in the direction of arrangement of the stylus electrodes H, ion streams generated from the adjacent stylus electrodes H, respectively, are repelled by each other and are thus less likely to diffuse uniformly.

It has thus been found that, in the conventional corona discharge device such as presented in JP-A 6-11946, even in the absence of abrasion of the projections, adhesion of discharge products, and the like problem, the charged potential of an object to be charged is caused to drop at a position thereof opposed to a point midway between the adjacent projections due to the repulsion of ion streams, with a consequent deterioration in the charging uniformity of an object to be charged. It has also been found that, even in the case of designing the apparatus so that electric discharge occurs at all of the projections by setting the projection pitch to be relatively wide or by inserting an electric resistor element as in the charging device presented in JP-A 5-2314 and JP-A 8-160711, the charged potential of an object to be charged is caused to drop at a position thereof opposed to a point midway between the adjacent projections, and that the drop of the charged potential of an object to be charged becomes increasingly significant as the pitch of the projections is increased.

Next, for verification of the inability of the charging device presented in JP-A 11-212335 to resolve the above-described problem of a drop in the charged potential of an object to be charged, an electric discharge test was conducted with use of a charging device 57 as shown in FIG. 10 that is identical in structure with said charging device. FIG. 10 is a schematic diagram showing the charging device 57 as viewed from a surface of an object to be charged. The charging device 57 comprises a plurality of projections 55 and electric field regulation members 54. The electric field regulation members 54 are arranged symmetrically with respect to a straight line Z which passes through the tip end of the projection 55 and is thus perpendicular to the direction of arrangement of the projections 55.

In the charging device 57, the electric field regulation member 54 caused a stream of ions 56 generated from the projection 55 to spread all around so as to be deflected in substantially square form. In this way, the stream of ions 56 generated from the projection 55 diffused in a wider area than does a stream of ions spreading in elliptical form.

However, the streams of ions 56 generated from the adjacent projections 55, respectively, were repelled by each other, and consequently the extent of diffusion in the direction of the length of the charging device 57 was lesser than in the case where no electric field regulation member 54 is provided. Therefore, upon moving an object to be charged relative to the direction of the width of the charging device 57, then the object to be charged was inconveniently moved relatively along the demarcations of the streams of ions 56, in consequence whereof there resulted a drop of a charged potential in streak form on the object to be charged. This gave rise to deterioration in the charging uniformity of the object to be charged.

FIG. 11 is a graph showing a distribution of charged potentials at an object to be charged in the case of using the charging device 57. It will be understood from the graph that, upon charging an object to be charged by the charging device 57, in contrast to a position P1, a position P2, a position P3, a position P4, a position P5, a position P6, and a position P7 on the object to be charged that are opposed to their respective projections 55, at positions on the object to be charged near a midway point M1 between P1 and P2, a midway point M2 between P2 and P3, a midway point M3 between P3 and P4, a midway point M4 between P4 and P5, a midway point M5 between P5 and P6, and a midway point M6 between P6 and P7, respectively, viz., at each position thereon opposed to a point midway between the adjacent projections, a drop in the charged potential occurs. It has thus been found that there is still lack of uniformity in charging on an object to be charged even in the case of using the charging device 57 comprising the electric field regulation member 54.

SUMMARY OF THE INVENTION

The invention has been devised in order to solve the foregoing problems, and accordingly its object is to provide a charging device capable of improvement in charging uniformity on an object to be charged, as well as an image forming apparatus comprising the charging device, and a method for forming a discharge electrode.

The invention provides a charging device comprising:

a shield case having an opening; and a discharge electrode disposed in an interior space of the shield case, having a plurality of projections aligned in one direction from which a stream of ions is generated, the plurality of projections each being so disposed that a width direction thereof makes a predetermined angle with a direction of arrangement of the plurality of projections, in order that streams of ions generated from the projections that are adjacent to each other in a lengthwise direction of the shield case can overlap each other when viewed in a widthwise direction of the shield case.

According to the invention, the projections of the discharge electrode each are disposed inclined so that a width direction thereof makes a predetermined angle with a direction of arrangement of the projections. Accordingly, a stream of ions generated from each of the projections is deflected obliquely with respect to the direction of arrangement of the projections. Correspondingly, an ion-stream demarcated portion (a portion with decreased ion stream density) resulting from the repulsion of the ion streams generated from the adjacent projections, respectively, are also deflected obliquely. Therefore, when an object to be charged is moved relative to the widthwise direction of the shield case, it never occurs that the direction of movement of an object to be charged and the portion with decreased ion stream density come into line with each other. Hence, even if an object to be charged is moved relative to the widthwise direction of the shield case, the ion stream density on an object to be charged will never become nonuniform. Accordingly, the charging device pursuant to the invention is capable of improving the charging uniformity of an object to be charged.

Moreover, in the invention, it is preferable that the discharge electrode is so constituted that the projections are inclined in the same direction and a condition of $p<W/\{2\tan(\alpha)\}+W/\{2\tan(\beta)\}$ is fulfilled, wherein W denotes a width of the shield case, $\alpha$ and $\beta$ denote predetermined angles of given two projections arranged adjacent to each other in a lengthwise direction of the shield case, respectively, and p denotes a pitch of tip ends of the two projections.

According to the invention, the discharge electrode is so constituted that the projections are inclined in the same direction and the condition of $p<W/\{2\tan(\alpha)\}+W/\{2\tan(\beta)\}$ is fulfilled. This makes it possible to adjust a stream of ions to deflect in an optimum condition and thereby construct a charging device which is excellent in charging uniformity.

Moreover, in the invention, it is preferable that the discharge electrode is so constituted that predetermined angles of all of the projections of the discharge electrode are the same.

According to the invention, the discharge electrode is so constituted that all of the projections thereof are at the same angle in the widthwise direction with respect to the direction of arrangement of the projections. This makes it possible to suppress the repulsion of ion streams generated from the projections and thereby improve the charging uniformity of an object to be charged even further in the direction of arrangement of the projections.

Moreover, in the invention, it is preferable that the charging device further comprises a holding portion for retaining the discharge electrode in the interior space of the shield case, the discharge electrode is constructed by bending a plate-like material, and the holding portion serves as a bending member which is used to form the discharge electrode by bending the plate-like material.

According to the invention, the discharge electrode can be retained in a bent state by the holding portion. This makes it possible to keep the angle of the projection in the widthwise direction with respect to the direction of arrangement of the projections with high accuracy, and thereby maintain the charging uniformity of an object to be charged in the direction of arrangement of the projections.

The invention also provides an image forming apparatus comprising:

an image bearing member for bearing an electrostatic latent image thereon; and the charging device mentioned above, the image bearing member being charged by the charging device.

According to the invention, since the image bearing member is charged by the charging device pursuant to the invention, it is possible to form high-quality images. Moreover, the image forming apparatus pursuant to the invention is capable of a reduction in the amount of ozone generation entailed by charging operation. Further, since the charging device pursuant to the invention achieves improvement in charging uniformity with a simple structure, it is possible to make the image forming apparatus compact in size at low cost.

The invention further provides a discharge electrode forming method for forming a discharge electrode which is provided in the charging device mentioned above by bending a single plate-like material.

According to the invention, the discharge electrode is formed simply by bending a single plate-like material. This makes it possible to achieve formation of the discharge electrode with ease and at low cost.

Moreover, in the invention, it is preferable that the plate-like material is bent in such a manner that widthwise one end of the respective projections of the discharge electrode is separated from the plate-like material, whereas widthwise the other end thereof is kept connected with the plate-like material.

According to the invention, the discharge electrode is formed by bending the plate-like material in such a manner that widthwise one end of the respective projections is separated from the plate-like material, whereas widthwise the other end thereof is kept connected with the plate-like material. This helps reduce the amount of the plate-like material to be used.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
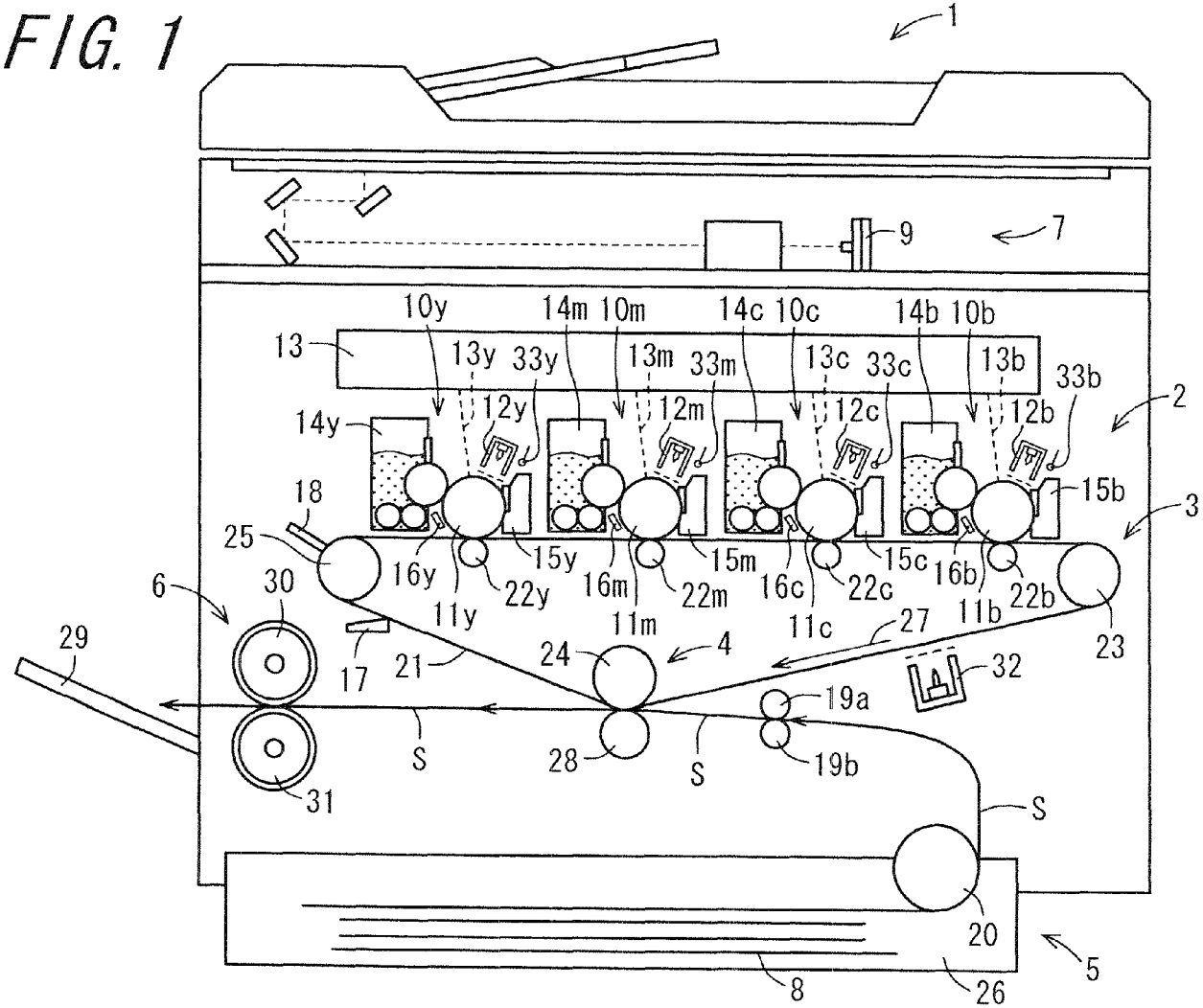
FIG. 1 is a diagram schematically showing a cross-section of an image forming apparatus.

Now referring to the drawings, preferred embodiments of the invention will be described in detail.

An image forming apparatus 1 which is an embodiment of the image forming apparatus pursuant to the invention comprises an image bearing member and a charging device 12 which is a first embodiment of the charging device pursuant to the invention. FIG. 1 is a diagram schematically showing a cross-section of the image forming apparatus 1. The image forming apparatus 1 is built as an electrophotographic image forming apparatus of tandem design for forming images by overlaying toner images of four colors: yellow (y); magenta (m); cyan (c); and black (b) on top of one another to form a multi-color toner image and then fixing the multi-color toner image onto a recoding medium. The image forming apparatus 1 includes a toner image forming section 2, an intermediate transfer section 3, a secondarily transfer section 4, a recording medium supply section 5, a fixing section 6, a scanner section 7, and a control unit section (not shown).

The scanner section 7 includes an original platen, a light source, and a CCD (Charge Coupled Device) image sensor 9. On the top surface of the original platen is placed a source document to be copied. The original platen is constructed of a plate-like member made of a transparent material such as transparent glass. The light source illuminates the source document placed on the original platen. The CCD image sensor 9 performs photoelectric conversion on light reflected from the source document illuminated by the light source thereby to convert the reflected light into image information (analog signal).

The CCD image sensor 9 includes a conversion portion, a transmission portion, and an output portion. The conversion portion converts an optical signal, which is reflected light, into an electrical signal. The transmission portion transmits electrical signals one after another to the output portion in synchronization with clock pulses. The output portion converts an electrical signal into a voltage signal, amplifies the voltage signal, and puts it out with a decrease in impedance.

The control unit section, which controls overall workings of the image forming apparatus 1, includes a control portion, a calculation portion, and a memory portion as will hereinafter be described, for converting an analog signal thereby obtained into a digital signal through heretofore known image processing. The image information of the source document read out by the scanner section 7 is sent to the control unit section where it is converted into a digital signal through various image processing steps, and is whereafter stored in the memory portion of the control unit section. The image information stored in the memory portion is retrieved from the memory portion in response to an output instruction, and is then transmitted to an optical scanning unit 13 which will hereinafter be described.

According to the scanner section 7, the source document placed on the original platen is illuminated by the light source, and the light reflected from the illuminated source document is converted into analog image information by the CCD image sensor 9. The image information is changed from analog signal form to digital signal form by the control unit section, and the digital image information is stored in the memory portion.

The toner image forming section 2 includes visible image forming units 10*y*, 10*m*, 10*c*, and 10*b*, and the optical scanning unit 13. The visible image forming units 10*y*, 10*m*, 10*c*, and 10*b* are arranged side by side, in the order named, from the upstream side in a direction in which a subsequently-described intermediate transfer belt 21 is driven to turn; that is, in a direction indicated by an arrow 27. The visible image forming units 10*y*, 10*m*, 10*c*, and 10*b* form electrostatic latent images corresponding to image information of their respective colors inputted as digital signals, and then supply toner to the electrostatic latent images thereby to form toner images of their respective colors.

The visible image forming unit 10*y* forms a toner image corresponding to yellow (y) image information. The visible image forming unit 10*m* forms a toner image corresponding to magenta (m) image information. The visible image forming unit 10*c* forms a toner image corresponding to cyan (c) image information. The visible image forming unit 10*b* forms a toner image corresponding to black (b) image information. As to the visible image forming units 10*y*, 10*m*, 10*c*, and 10*b* that are provided to deal with different colors, collectively, they are designated only by the general reference numeral 10. On the other hand, when it is desired to make distinctions among the visible image forming units 10*y*, 10*m*, 10*c*, and 10*b* according to their colors, they are designated by the reference numeral 10 with the alphabetical suffix indicative of specific color. The above conditions hold true for the individual components constituting the visible image forming unit 10.

The visible image forming unit 10 includes a photoreceptor drum 11, a charging device 12, a developing portion 14, a drum cleaner 15, a pre-primary transfer charging portion 16, a primary transfer portion 22, and a photoreceptor charge eliminating portion 33.

The photoreceptor drum 11 is constructed of a roller-shaped member which is so supported as to be driven to rotate about its axis by a non-illustrated driving portion. The photoreceptor drum 11 includes a photosensitive layer and serves as an image bearing member for bearing, on the surface of the photosensitive layer, an electrostatic latent image and thus a toner image.

As exemplary of the photoreceptor drum 11, a component composed of a conductive substrate made of aluminum or the like and a photosensitive layer formed on a surface of the conductive substrate can be used. As exemplary of the conductive substrate, a cylindrical conductive substrate, a columnar conductive substrate, and a sheet-shaped conductive substrate can be used. Among them, the use of a cylindrical conductive substrate is particularly desirable. Exemplary of the photosensitive layer are an organic photosensitive layer and an inorganic photosensitive layer.

Examples of the organic photosensitive layer include a laminated body including a charge generating layer which is a charge generating substance-containing resin layer and a charge transporting layer which is a charge transporting substance-containing resin layer; and a single resin layer containing both a charge generating substance and a charge transporting substance. Examples of the inorganic photosensitive layer include a resin layer containing one or two or more of substances selected among from zinc oxide, selenium, amorphous silicon, and so forth.

It is possible to interpose an undercoat layer between the conductive base body and the photosensitive layer, as well as to provide a surface layer (protective layer) on the surface of the photosensitive layer for its protection.

Figure 2:
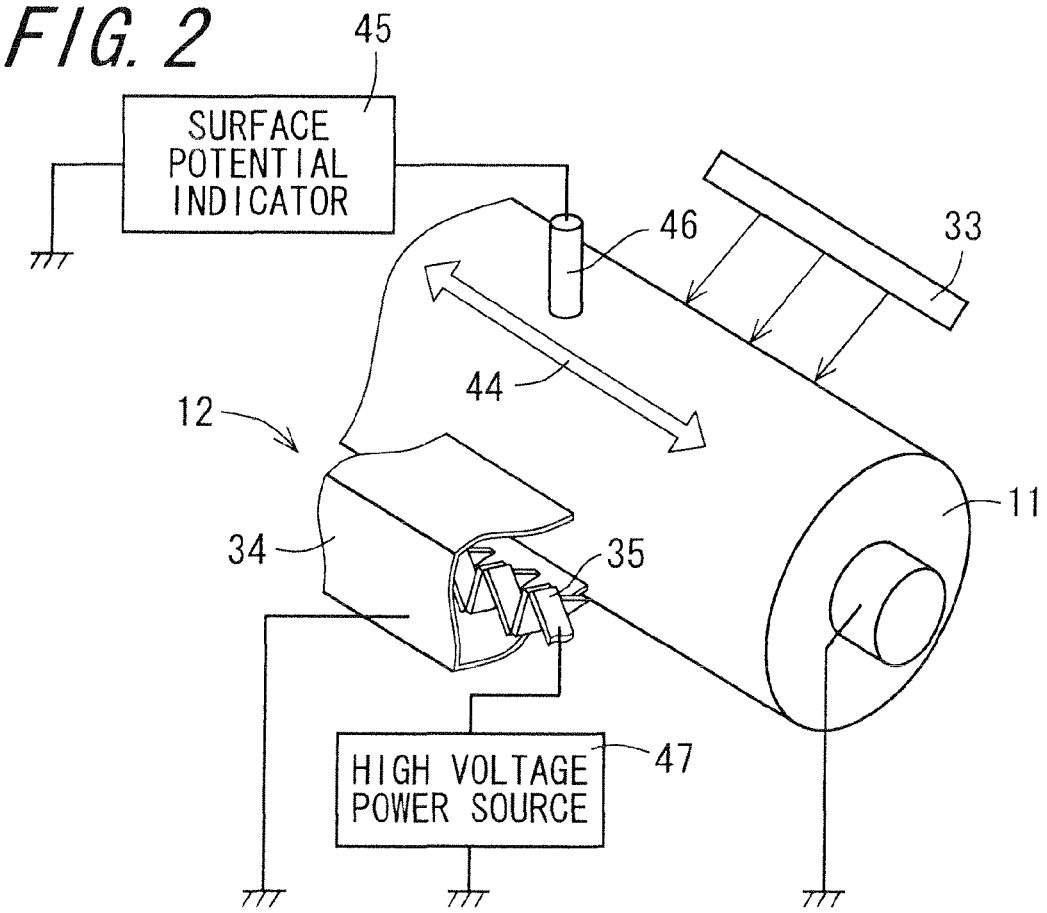
FIG. 2 is a view schematically showing an outer appearance of a charging device and a photoreceptor drum.

FIG. 2 is a view schematically showing the outer appearance of the charging device 12 and the photoreceptor drum 11. The charging device 12 is disposed to face the photoreceptor drum 11 so as to extend along a lengthwise direction 44 of the photoreceptor drum 11. The charging device 12 comprises a discharge element 35 and a shield case 34. Also provided in the charging device 12 are a surface potential indicator 45 and a surface potential probe 46 for measuring the surface potential of the photoreceptor drum 11. It is noted that, in an embodiment of the charging device 12, the surface potential probe 46 and the surface potential indicator 45 do not necessarily have to be provided.

The discharge element 35 comprises a discharge electrode which is an electrode to be connected with a high voltage power source 47. The discharge electrode has a plurality of projections. In the discharge electrode, upon application of a voltage thereto by the high voltage power source 47, corona discharge takes place in at least one of the projections.

Although a voltage applied by the high voltage power source 47 varies in polarity depending upon which one of opposite polarities is to be selected for the charging of an object to be charged, the absolute value of an applied voltage is so adjusted as to fall in the range from 4 kV to 10 kV. Moreover, although a required applied voltage varies depending upon the distance between the discharge element 35 and another constituent member of the charging device 12, from a transformer cost standpoint, as well as from a safety standpoint, the maximum value (absolute value) of the applied voltage should preferably be set at or below 10 kV.

The shield case 34 is a box-shaped member having an opening formed in a wall portion thereof facing the photoreceptor drum 11. The shield case 34 has an interior space in which the discharge element 35 is disposed. The shield case 34 is so disposed that its lengthwise direction coincides with the lengthwise direction 44 of the photoreceptor drum 11. The shield case 34 has a substantially C-shaped cross-section when viewed in a direction perpendicular to the lengthwise direction.

The shield case 34 is connected to ground or is connected to a power source (not shown). When connected to the power source, the shield case 34 receives application of a voltage of the same polarity as the polarity of a voltage applied to the discharge electrode. The absolute value of a voltage to be applied to the shield case 34 falls in the range from 0 kV to 1 kV.

The charging device 12 of the present embodiment is built as a scorotron-type charging device having a grid electrode (not shown) which is disposed between the discharge electrode and the photoreceptor drum 11. The grid electrode is made of a thin-plate metal, and is spaced away from the projection of the discharge electrode by a distance falling in the range of from 4 mm to 12 mm. For example, the grid electrode may be spaced a distance of 7 mm away from the projection. It is noted that, by way of an embodiment of the invention, the charging device may be built as a corotron-type charging device not comprising a grid electrode.

The grid electrode has a plurality of through holes formed so as to pass therethrough in its thicknesswise direction, and is connected to a bias power supply (not shown). The grid electrode receives, from the bias power supply, application of a voltage of the same polarity as the polarity of a voltage applied to the discharge electrode. The absolute value of a voltage to be applied to the grid electrode is adjusted properly to the level required for image formation. For example, the absolute value is adjusted to a level in the range from 300 V to 1 kV.

According to the charging device 12, corona discharge takes place at the projection of the discharge electrode under application of a voltage by the high voltage power source 47. More specifically, a voltage to be applied to the discharge electrode is adjusted within the foregoing range in such a manner that the absolute value of the amount of current applied to the discharge electrode as a whole falls in the range from 200 μA to 1000 μA.

Regardless of a polarity at which an object to be charged is charged, a stream of ions which travels toward an object to be charged is generated by the corona discharge occurring in the charging device 12. The invention is concerned with the charging device capable of control (deflection) of a stream of ions generated from the projection of the discharge electrode, and an object to be charged can be charged at either polarity. The charging device pursuant to the invention will hereinafter be described in detail.

The optical scanning unit 13 applies beams of laser light 13*y*, 13*m*, 13*c*, and 13*b*, which correspond to image information of different colors, to the surfaces of, respectively, the photoreceptor drums 11*y*, 11*m*, 11*c*, and 11*b* in a charged state. In this way, on the surfaces of, respectively, the photoreceptor drums 11*y*, 11*m*, 11*c*, and 11*b*, there are formed electrostatic latent images corresponding to image information of their respective colors. As the optical scanning unit 13, a semiconductor laser or the like can be used.

The developing portion 14 includes a developing roller, a regulation blade, a developer tank, and a stirring roller. The developing roller is a roller-shaped member which is supported so as to be rotatable about its axis in the developer tank. The developing roller is so disposed that a part thereof extends outwardly into close proximity to the surface of the photoreceptor drum 11 from an opening formed on a surface of the developer tank that faces the photoreceptor drum 11.

The developing roller has a stationary magnetic pole (not shown) disposed therein. A developer is borne on the surface of the developing roller by the action of the stationary magnetic pole. In a location where the developing roller and the photoreceptor drum 1 lie in close proximity to each other (development nip region), the developing roller supplies the developer borne thereon to an electrostatic latent image formed on the surface of the photoreceptor drum 11. The developing roller is driven to rotate in a direction reverse to the direction of rotation of the photoreceptor drum 11. Accordingly, in the development nip region, the surface of the developing roller and the surface of the photoreceptor drum are moved in the same direction.

The developing roller is connected to a power source (not shown) and receives, from the power source, application of a do voltage (development voltage). In this way, the developer borne on the surface of the developing roller can be supplied smoothly to an electrostatic latent image.

The regulation blade is a plate-like member which has its one end supported by the developer tank and has the other end spaced away from the surface of the developing roller. The regulation blade acts to render uniform the thickness of a developer layer borne on the surface of the developing roller.

The developer tank is a container-shaped member with an interior space having an opening formed on a surface thereof that faces the photoreceptor drum 11. In the interior space of the developer tank, the stirring roller is disposed and also a developer is stored. The developer tank is replenished with a developer from a developer replenishing portion (not shown) according to the condition of developer consumption. As the developer, any of those used customarily in the relevant field can be used. The developer may be either of a one-component developer composed solely of a toner or of a two-component developer composed of a toner and a carrier.

The stirring roller is a screw-shaped member which is supported so as to be rotatable about its axis in the interior space of the developer tank. The stirring roller feeds the developer stored in the developer tank to a region around the surface of the developing roller as it is rotatably driven.

According to the developing portion 14, the developer stored in the developer tank is fed to the surface of the developing roller by the stirring roller, thereby forming a developer layer on the surface of the developing roller. The developer layer is made uniform in layer thickness by the regulation blade. After that, in the presence of potential difference between the photoreceptor drum 11 and the developing roller, the developer is selectively supplied to an electrostatic latent image formed on the surface of the photoreceptor drum 11. In this way, on the surface of the photoreceptor drum 11 is formed a toner image corresponding to image information.

The pre-primary transfer charging portion 16 is a charging device for charging a toner image formed on the surface of the photoreceptor drum 11. As the pre-primary transfer charging portion 16, components identical with the charging device 12 can be used.

The primary transfer portion 22 is a roller-shaped member which is so disposed as to be driven to rotate about its axis by a driving portion (not shown). The primary transfer portion 22 is disposed to face the photoreceptor drum 11, with the intermediate transfer belt 21 interposed therebetween, and is brought into pressure-contact with a surface of the intermediate transfer belt 21 opposed to the surface thereof making contact with the photoreceptor drum 11. For example, a roller-shaped member composed of a metal-made shaft body and a conductive layer which covers the surface of the metal-made shaft body is used for the primary transfer portion 22.

The metal-made shaft body is formed of a metal material such as stainless steel. The conductive layer is formed of a conductive elastic element or the like. As the conductive elastic element, any of those used customarily in the relevant field can be used. Examples thereof include ethylene propylene diene rubber (EPDM), foamed EPDM, and foamed urethane containing a conductive agent such as carbon black.

The primary transfer portion 22 is connected to a high voltage power source (not shown). The primary transfer portion 22 receives, from the high voltage power source, application of a high voltage of a polarity reverse to the polarity at which the toner image formed on the surface of the photoreceptor drum 11 is charged. In this way, the toner image formed on the surface of the photoreceptor drum 11 can be transferred to the surface of the intermediate transfer belt 21.

The drum cleaner 15 removes and collects a residual developer remaining on the surface of the photoreceptor drum 11 after the toner image formed on the surface of the photoreceptor drum 11 is transferred to the intermediate transfer belt 21.

The photoreceptor charge eliminating portion 33 performs charge elimination on the photoreceptor drum 11 after the residual developer remaining thereon is collected by the drum cleaner 15. An illuminating device such as a lamp can be used for the photoreceptor charge eliminating portion 33.

According to the toner image forming section 2, the photoreceptor drum 11 is charged by the charging device 12. The optical scanning unit 13 applies laser light, which corresponds to image information in digital signal form stored in the memory portion, to the photoreceptor drum 11 in a charged state thereby to form an electrostatic latent image. The developing portion 14 supplies a developer to the electrostatic latent image to form a toner image on the surface of the photoreceptor drum 11. The toner image is primarily transferred onto the intermediate transfer belt 21 by the primary transfer portion 22.

The intermediate transfer section 3 includes a transfer belt cleaner 17, a transfer-belt charge eliminating portion 18, the intermediate transfer belt 21, and supporting rollers 23, 24, and 25. The intermediate transfer belt 21 is an endless belt-shaped member supported around the supporting rollers 23, 24, and 25 with tension, to form a loop-like traveling path. The intermediate transfer belt 21 is turned to move in the direction indicated by the arrow 27 at a circumferential velocity which is substantially equal to that of the photoreceptor drum 11 while bearing the toner image transferred thereto from the photoreceptor drum 11. For example, the intermediate transfer belt 21 is turned to move at a circumferential velocity in range of from 167 mm/s to 225 mm/s.

For example, a 100 μm-thick polyimide film can be used for the intermediate transfer belt 21. The material used for the intermediate transfer belt 21 is however not limited to a polyimide film but may be films made of synthetic resin such as polycarbonate, polyamide, polyester, and polypropylene, or films made of rubber of various types. In order to make adjustment to the value of electrical resistance of the intermediate transfer belt 21, the film in use made of synthetic resin or rubber of various types is blended with a conductive substance such as furnace black, thermal black, channel black, and graphite carbon.

Each of the supporting rollers 23, 24, and 25 is a roller-shaped member which is so disposed as to be driven to rotate about its axis by a driving portion (not shown). For example, an aluminum-made cylindrical element (pipe-shaped roller) is used for the supporting rollers 23, 24, and 25.

The supporting roller 24 is disposed downstream from the photoreceptor drum 11*b* in a direction in which the intermediate transfer belt 21 is turnably driven. The supporting roller 24 is brought into pressure-contact with a subsequently-described secondary transfer roller 28, with the intermediate transfer belt 21 interposed therebetween, thereby forming a secondary transfer nip region. The supporting roller 24 is electrically connected to ground. The supporting roller 24 not only acts to support the intermediate transfer belt 21 therearound with tension, but also to allow a toner image borne on the intermediate transfer belt 21 to be secondarily transferred onto a recording medium.

The transfer belt cleaner 17 is disposed downstream from the supporting roller 24 in the direction of turnably driving the intermediate transfer belt 21. The transfer belt cleaner 17 is a member for removing a residual toner remaining on the intermediate transfer belt 21 after a toner image borne on the intermediate transfer belt 21 is transferred onto a recording medium.

The transfer belt cleaner 17 includes a cleaning blade and a toner storage container (not shown). The cleaning blade is a plate-like member which is brought into pressure-contact with a surface of the intermediate transfer belt 21 for bearing a toner image thereon, for scraping a residual toner and so forth off the intermediate transfer belt 21. For example, an elastic rubber material (such as urethane rubber) can be used for the cleaning blade. The toner storage container is a container-shaped member for temporarily storing therein a residual toner and so forth scraped by the cleaning blade.

The transfer-belt charge eliminating portion 18 is disposed downstream from the transfer belt cleaner 17 in the direction of turnably driving the intermediate transfer belt 21, and is disposed upstream from the photoreceptor drum 11*y*. The transfer-belt charge eliminating portion 18 is a brush-shaped member for performing charge elimination on the intermediate transfer belt 21 after the residual toner remaining on the intermediate transfer belt 21 is removed by the transfer belt cleaner 17.

According to the intermediate transfer section 3, toner images of different colors formed on the photoreceptor drums 11*y*, 11*m*, 11*c*, and 11*b*, respectively, are overlaid together in a predetermined location on the surface of the intermediate transfer belt 21 for bearing toner images thereon, thereby forming a multi-color toner image. As will hereinafter be described, the multi-color toner image is secondarily transferred onto a recording medium in the secondary transfer nip region. Following the completion of the secondary transfer, toner, offset toner, paper powder, and so forth remaining on the intermediate transfer belt 21 are removed by the transfer belt cleaner 17. Following the completion of the removal of a residual toner and so forth, the intermediate transfer belt 21 is subjected to charge elimination at the transfer-belt charge eliminating portion.

The recording medium supply section 5 includes registration rollers 19*a* and 19*b*, a pick-up roller 20, and a recording medium cassette 26. The recording medium cassette 26 stores therein recording mediums 8. Examples of the recording medium 8 include plain paper, coated paper, color copy-specific paper, a film for OHP, and a postcard. There are recording mediums 8 of varying sizes: A4 size; A3 size; B5 size; B4 size; postcard size; and so forth.

The pick-up roller 20 is a roller-shaped member for feeding the recording mediums 8 to a paper conveyance path S one by one. The registration rollers 19*a* and 19*b* are a pair of roller-shaped members that are so disposed as to make pressure-contact with each other. The registration rollers 19*a* and 19*b* feed the recording medium 8 to the secondary transfer nip region in synchronism with the conveyance of a multi-color toner image borne on the intermediate transfer belt 21 to the secondary transfer nip region.

According to the recording medium supply section 5, the recording mediums 8 stored in the recording medium cassette 26 are fed to the conveyance path S one by one by the pick-up roller 20, and are then fed to the secondary transfer nip region by the registration rollers 19*a* and 19*b*.

The secondary transfer section 4 includes a pre-secondary transfer charging portion 32 and the secondary transfer roller 28. The pre-secondary transfer charging portion 32 is a charging device for charging a multi-color toner image borne on the intermediate transfer belt 21. As the pre-secondary transfer charging portion 32, components identical with the charging device 12 can be used.

The secondary transfer roller 28 is a roller-shaped member which is so disposed as to make pressure-contact with the supporting roller 24, with the intermediate transfer belt 21 interposed therebetween. The secondary transfer roller 28 is driven to rotate about its axis by a driving portion (not shown). For example, a roller-shaped member composed of a metal-made shaft body and a conductive layer which covers the surface of the metal-made shaft body is used for the secondary transfer roller 28.

For example, the metal-made shaft body is formed of a metal material such as stainless steel. The conductive layer is formed of a conductive elastic element or the like. As the conductive elastic element, any of those used customarily in the relevant field can be used. Examples thereof include EPDM, foamed EPDM, and foamed urethane containing a conductive agent such as carbon black.

The secondary transfer roller 28 is connected to a high voltage power source (not shown). The secondary transfer roller 28 receives, from the high voltage power source, application of a high voltage of a polarity reverse to the polarity at which the multi-color toner image borne on the intermediate transfer belt 21 is charged. In this way, the multi-color toner image borne on the intermediate transfer belt 21 is transferred to the surface of the recording medium 8 in the secondary transfer nip region.

According to the secondary transfer section 4, a multi-color toner image borne on the intermediate transfer belt 21 is secondarily transferred onto the recording medium 8 fed from the recording medium supply section 5. The recording medium 8 bearing an unfixed multi-color toner image, is conveyed to the fixing section 6.

The fixing section 6 includes a paper discharging portion 29, a fixing roller 30, and a pressure roller 31. The fixing roller 30 is a roller-shaped member which is so supported as to be driven to rotate about its axis by a driving portion (not shown). Inside the fixing roller 30, a heating portion such as a halogen lamp is provided. The fixing roller 30 causes toner constituting the unfixed multi-color toner image borne on the recording medium 8 to melt under application of heat, thereby fixing the toner image onto the recording medium 8.

For example, a roller-shaped member composed of a core metal, an elastic layer, and a surface layer can be used for the fixing roller 30. As a metal constituting the core metal, a metal having high thermal conductivity can be used. Examples of such a metal include aluminum and iron. While the core metal can be of a cylindrical shape, a columnar shape, or the like shape, a cylindrical shape is desirable. This is because a cylindrical-shaped core metal dissipates a lesser amount of heat.

While there is no particular limitation to the material for forming the elastic layer so long as it exhibits rubber elasticity, an elastic rubbery material having excellent heat resistance is preferable for use. Specific examples thereof include silicone rubber, fluorine-containing rubber, and fluorosilicone rubber. Among them, silicone rubber is particularly desirable because of its superiority in rubber elasticity.

There is no particular limitation to the material for forming the surface layer so long as it excels in heat resistance and durability and is low in toner adherability. Examples of the material include a fluorinated resin material, such as PFA (copolymer of tetrafluoroethylene and perfluoroalkyl vinyl ether) and PTFE (polytetrafluoroethylene), and fluorine-containing rubber.

The pressure roller 31 is a roller-shaped member disposed vertically below the fixing roller 30 so as to be freely rotatable while being kept in pressure-contact with the fixing roller 30. A location where the fixing roller 30 and the pressure roller 31 make pressure-contact with each other is defined as a fixing nip region. The pressure roller 31 is caused to rotate dependently as the fixing roller 30 is rotatably driven. At the time of fixing a multi-color toner image onto the recording medium 8 under application of heat, the pressure roller 31 assists in the fixation of the multi-color toner image onto the recording medium 8 by pressing the toner of the image in an molten state against the recording medium 8.

For example, a roller-shaped member composed of a core metal, an elastic layer, and a surface layer can be used for the pressure roller 31. As the core metal, the elastic layer, and the surface layer, those that are the same as the core metal, the elastic layer, and the surface layer, respectively, of the fixing roller 30 can be used. Moreover, just like the fixing roller 30, inside the pressure roller 31, a heating portion may be provided. The paper discharging portion 29 is a tray-shaped member for storing the recording medium 8 with a multi-color toner image fixed thereon.

According to the fixing section 6, an unfixed multi-color toner image borne on the recording medium 8 is caused to melt under application of heat and is thus fixed onto the recording medium 8. The recording medium 8 with the multi-color toner image fixed thereon is discharged onto the paper discharging portion 29, whereupon image formation is completed.

The image forming apparatus 1 includes the control unit section (not shown). For example, the control unit section is disposed in an upper area of the interior space of the image forming apparatus 1 in a vertical direction, and includes a memory portion, a calculation portion, and a control portion. The memory portion of the control unit section receives input of, for example, various set values provided through a operation panel (not shown) disposed on the top surface of the image forming apparatus 100 in the vertical direction, the results of detection produced by sensors or the like devices (not shown) arranged at predetermined positions in the interior of the image forming apparatus 1, and image information provided from external equipment. Moreover, programs for executing various processing steps are written to the memory portion. For example, the "various processing steps" include a recording medium identifying process, an attachment amount control process, and a fixing condition control process.

As the memory portion, any of those used customarily in the relevant field can be used. Examples thereof include a read-only memory (ROM), a random-access memory (RAM), and a hard disk drive (HDD). As the external equipment, an electrical or electronic apparatus which is capable of formation or acquisition of image information and is electrically connectable to the image forming apparatus 1 can be used. Examples thereof include a computer, a digital camera, a television set, a video recorder, a DVD (Digital Versatile Disc) recorder, a HDDVD (High-Definition Digital Versatile Disc) recorder, a Flu-ray Disc recorder, a facsimile machine, and a portable terminal apparatus.

The calculation portion retrieves various data written to the memory portion (image formation commands, detection results, image information, etc.) and the programs for the various processing steps to make various determinations. In response to the result of determination made by the calculation portion, the control portion issues a control signal to an appropriate device thereby to exercise operational control.

The control portion, as well as the calculation portion, includes a processing circuit implemented by a microcomputer, a microprocessor, or the like having a central processing unit (CPU). The control unit section includes, in addition to the processing circuit described just above, a main power supply for supplying electric power not only to the control unit section but also to various components incorporated in the image forming apparatus 1.

Figure 3B:
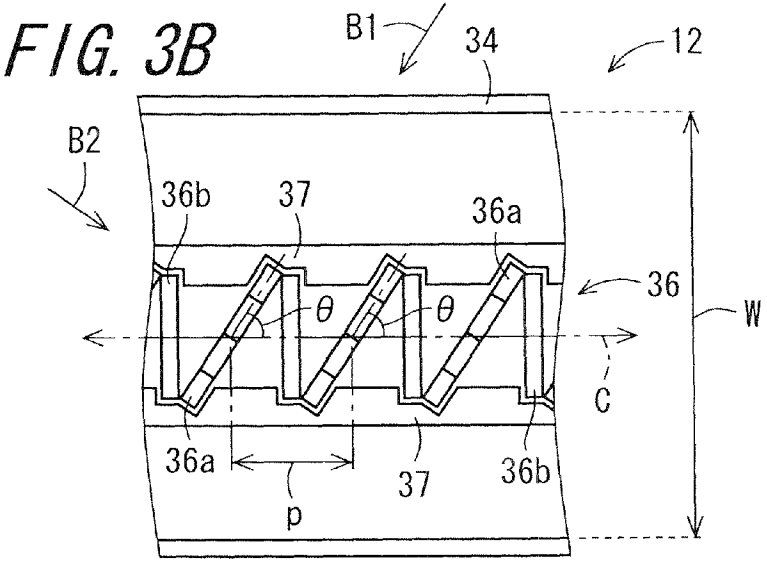
FIGS. 3A to 3C are views showing the structure of the charging device.
Figure 3C:
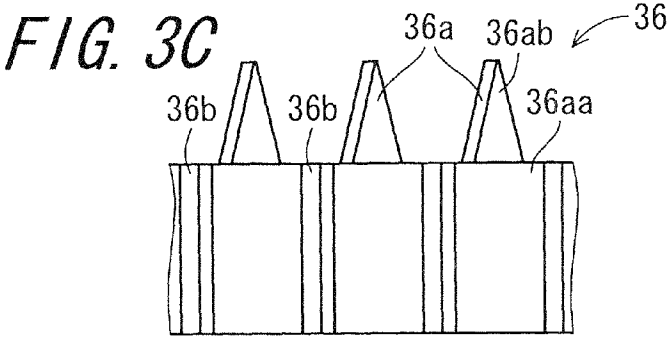
Figure 3A:
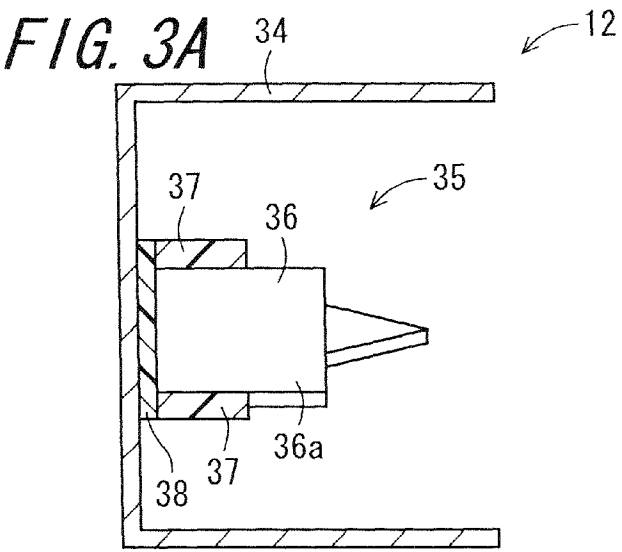

Next, the charging device 12 pursuant to the invention will be described in detail. FIGS. 3A to 3C are views showing the structure of the charging device 12. FIG. 3A is a view showing the cross-section of the charging device 12 with respect to the lengthwise direction of the shield case 34. FIG. 3B is a view of the interior space of the shield case 34 as viewed from the opening of the shield case 34. FIG. 3C is a side view of a discharge electrode 36 which is a part of the charging device 12. The charging device 12 includes the discharge element 35 and the shield case 34. The discharge element 35 includes the discharge electrode 36, a holding portion 37, and an attaching portion 38.

The shield case 34 is a box-shaped member made of a metal material. For example, an iron material plated with nickel can be used as the metal material. The width of the shield case 34, expressed differently, a width W of the interior space of the shield case 34, can be determined arbitrarily so long as it falls in the range of 8 mm or more and 30 mm or less. In this embodiment, the width W is set at 14 mm. The thickness of the shield case 34 can be adjusted in the range of from 0.5 mm to 2 mm.

The attaching portion 38 is a member for attaching the discharge electrode 36 and the holding portion 37 thereto. In the interior space of the shield case 34, the attaching portion 38 is attached centrally of the inner wall of the shield case 34 opposed to the opening of the shield case 34. An insulating material such as a polycarbonate resin or an ABS resin (acrylonitrile butadiene styrene resin) can be used for the attaching portion 38.

The discharge electrode 36 comprises a plurality of projections 36*a* arranged along the lengthwise direction of the charging device 12, each of which protrudes toward the opening of the shield case 34, and connecting portions 36*b* for connecting the projections 36*a* adjacent to each other in an arrangement direction C which is the direction of arrangement of the projections 36*a*. The discharge electrode 36 is constructed by arranging the projections 36*a* and the connecting portions 36*b* in zigzag form.

In the present embodiment, the discharge electrode 36 is constructed of a plate-like stainless material having a thickness falling in the range of from 0.1 mm to 0.2 mm. It is noted that the material used for the discharge electrode 36 is not limited to a stainless material but may be of INCONEL, tungsten, copper, iron, and the like. Moreover, the discharge electrode 36 may have its surface treated with nickel, chromium, or gold, or may have its surface plated with platinum, or gold and the underlying nickel (Ni—Au plating).

The discharge electrode 36 is so constituted that a widthwise direction of the projection 36*a* is inclined at a predetermined angle with respect to a first imaginary plane including the arrangement direction C (in FIG. 3B, a plane which includes the arrangement direction C and is perpendicular to the plane of diagram-bearing paper) on a second imaginary plane which includes the arrangement direction C and is perpendicular to the first imaginary plane (in FIG. 3B, a plane which includes the arrangement direction C and is parallel to the plane of diagram-bearing paper). In the present embodiment, the projections 36*a* have the same inclination angle θ. The angle θ can be determined arbitrarily so long as it falls in the range of 15° or more and 75° or less. In the present embodiment, the angle G is set at 45°.

A pitch p of the projections 36*a* can be determined arbitrarily so long as it falls in the range of 1 mm or more and 12 mm or less. In the present embodiment, the projections are arranged at the same pitch: p=8 mm. As has already been described with reference to FIGS. 8A to 8D, when the pitch p is unduly small, then there arises the possibility that, among the projections 36*a*, some bring forth corona discharge, but others don't as is undesirable. On the other hand, when the pitch p is unduly large, then the charging uniformity is likely to deteriorate as is undesirable.

The projection 36*a* comprises a rectangular portion 36*aa* and a triangular portion 36*ab* formed so as to extend from the rectangular portion 36*aa* in its protruding direction. The thickness of each of the rectangular portion 36*aa* and the triangular portion 36*ab* is adjusted in the range of from 0.1 mm to 0.2 mm. The triangular portion 36*ab* is so formed as to be pointed with a vertex having a radius of curvature in approximately the range of from 10 μm to 30 μm. The width of the triangular portion 36*ab* is adjusted in the range of from 0.5 mm to 1 mm. The length of the triangular portion 36*ab* in its protruding direction is adjusted in the range from 1 mm to 4 mm. Depending upon the values of the inclination angle θ and the pitch p, the width of the rectangular portion 36*aa* is adjusted in the range of from 1 mm to 30 mm, and the length of the rectangular portion 36*aa* in its protruding direction is adjusted in the range of from 2 mm to 10 mm.

The discharge electrode 36 is so constituted that a widthwise direction of the connecting portion 36*b* and the first imaginary plane form an angle of 90° on the second imaginary plane, in other words, the widthwise direction of the connecting portion 36*b* and the widthwise direction of the shield case 34 are parallel to each other. The connecting portion 36*b* is rectangular-shaped, has a thickness falling in the range of from 0.1 mm to 0.2 mm, has a width falling in the range of from 1 mm to 20 mm, depending upon the values of the inclination angle θ and the pitch p, and has a length falling in the range of from 2 mm to 10 mm in its protruding direction.

Using the pitch p and the inclination angle θ, the width of the rectangular portion 36*aa* and the width of the connecting portion 36*b* are expressed by the following formulae, respectively:

$$\text{Width of the rectangular portion } 36aa = p/\cos\theta$$

$$\text{Width of the connecting portion } 36b = p(\tan\theta)$$

Accordingly, where the foregoing ranges (p: 1 mm to 12 mm, θ: 15° to 75°) are fulfilled, then the width of the rectangular portion 36*aa* and the width of the connecting portion 36*b* fall in the following ranges, respectively:

Width of the rectangular portion 36*aa:* 1 mm to 46.4 mm

Width of the connecting portion 36*b:* 0.3 mm to 44.8 mm

In the case of setting the width of the connecting portion 36*b* at a large value, when the prevention of leakage to the shield case 34 and the convenience of mounting operation should be considered, there arises a need to adjust the distance between the shield case 34 and the connecting portion 36*b* to be large correspondingly in accordance with the width of the connecting portion 36*b*. For example, assuming the width of the shield case 34 of 30 mm, in the case of setting the width of the connecting portion 36*b* at a large value (the pitch p takes on a large value, and so does the inclination angle θ (60° to 75°)), from the standpoint of leak prevention and so forth, the upper limit of the width of the connecting portion 36*b* is approximately 20 mm. It is noted that, as a matter of practicality, in the case of setting the pitch p at a large value, the inclination angle θ is adjusted to be small to reduce the width of the connecting portion 36*b*, with the consequent prevention of leakage.

In contrast, where the width of the rectangular portion 36*aa* and the width of the connecting portion 36*b* are each set at a value as small as approximately 1 mm (the pitch p takes on a small value, and so does the inclination angle θ), then the discharge electrode 36 is susceptible to breakage in the course of manufacture, and furthermore the inclination angles θ cannot be rendered uniform with high accuracy. Hence, as a matter of practicality, in the case of setting the pitch p at a small value, the inclination angle θ is adjusted to be large with consideration given to the easiness of manufacture.

The holding portion 37 is a member for sandwiching the discharge electrode 36 so as to keep the inclination angle θ of the projection 36*a* in the widthwise direction of the shield case 34. An insulating material such as a polycarbonate resin or an ABS resin can be used for the holding portion 37.

Figure 4C:
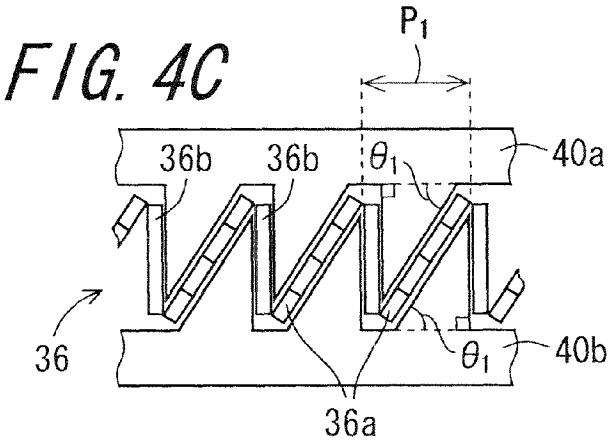
FIGS. 4A to 4C are views for explaining a method of forming a discharge electrode.
Figure 4A:
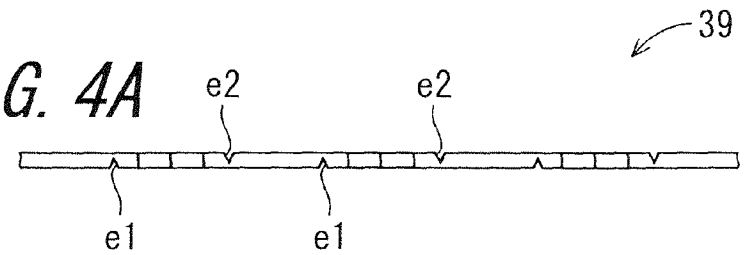
Figure 4B:
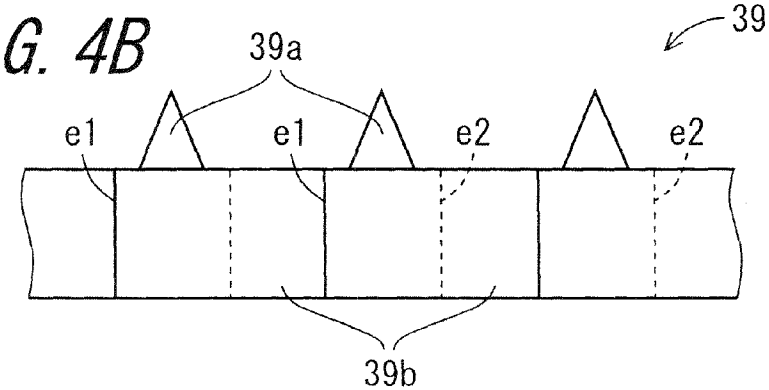

The discharge electrode 36 is made of a plate-like material 39 as shown in FIGS. 4A to 4C. FIGS. 4A to 4C are views for explaining a method of forming the discharge electrode 36. FIG. 4A is a front view of the plate-like material 39, FIG. 4B is a bottom view of the plate-like material 39, and FIG. 4C is a view showing how the plate-like material 39 is to be bent.

The plate-like material 39 is a single plate-like material formed with to-form-projection portions 39*a* and to-form-connection portions 39*b* arranged in alternate order. The to-form-projection portion 39*a* and the to-form-connection portion 39*b* become the projection 36*a* and the connecting portion 36*b*, respectively, through the bending of the plate-like material 39. The to-form-projection portion 39*a* and the to-form-connection portion 39*b* are each formed from a metal material having the shape of a rectangular flat plate by means of etching, press punching, or otherwise.

The plate-like material 39 is formed with half-etching portions e1 and e2 arranged in alternate order. The half-etching portion e1 is created by performing half etching at one side of the plate-like material 39, whereas the half-etching portion e2 is created by performing half etching at the other side of the plate-like material 39. That is, the half-etching portions e1 and e2 are each a groove formed by means of etching. The half-etching portion is so formed that the depth of the groove falls in the range of from 0.02 mm to 0.05 mm in the direction of thickness of the plate-like material 39. The to-form-projection portion 39*a* and the to-form-connection portion 39*b* are connected to each other through the half-etching portions e1 and e2.

The discharge electrode 36 can be formed by bending the plate-like material 39 with use of two bending members 40*a* and 40*b*. The bending member 40*a* is a member having serrations, each of which is formed at an inclination angle $\theta_1$ equal to the inclination angle of the projection 36*a*, arranged at a pitch p1 equal to the pitch p of the projections 36*a*. The bending member 40*b* is identical in configuration with the bending member 40*a*.

The bending member 40*a* and the bending member 40*b* are oriented in opposite directions, and the plate-like material 39 is interposed between the bending member 40*a* and the bending member 40*b*. Then, the bending member 40*a* and the bending member 40*b* are each pressed against the plate-like material 39, with each of the half-etching portions e1 and e2 caught at its back side by the extremity of the serration. In this way, the plate-like material 39 is bent in zigzag form, thereby forming the discharge electrode 36. That is, the discharge electrode 36 is formed simply by bending a single plate-like material 39. This makes it possible to achieve formation of the discharge electrode 36 with ease and at low cost. It is noted that, when the plate-like material 39 cannot be bent readily by the bending members 40*a* and 40*b* because of having a great thickness or high elasticity, or for other reasons, it is advisable to form the discharge electrode 36 by bending the plate-like material 39 properly with use of a different bending device.

The bending members 40*a* and 40*b* can be preferably used as the holding portion 37. In the case of using the bending members 40*a* and 40*b* as the holding portion 37, the bending members 40*a* and 40*b* are attached, with the discharge electrode 36 sandwiched therebetween, to the attaching portion 38.

Figure 5A:
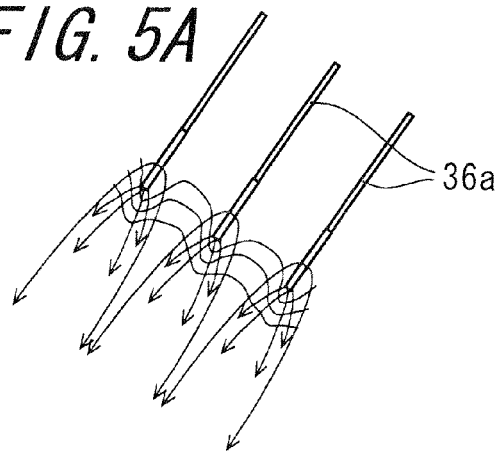
FIGS. 5A to 5C are views showing a state of a stream of ions generated from a projection.
Figure 5B:
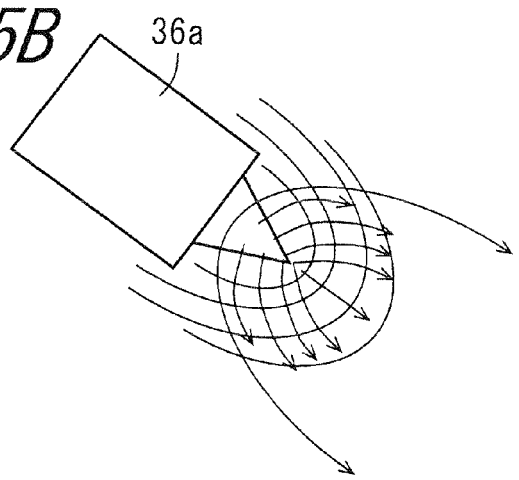
Figure 5C:
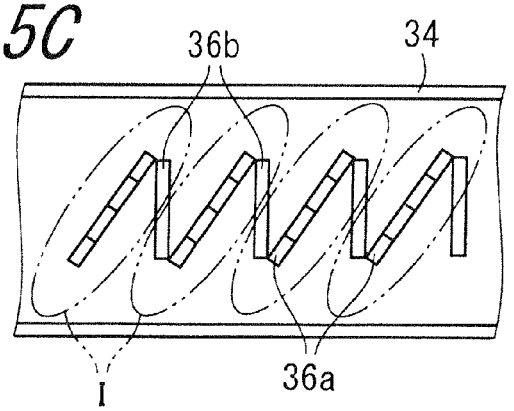

The following is an explanation for demonstrating the ability of the thereby constructed charging device 12 to improve the charging uniformity of an object to be charged. FIGS. 5A to 5C are views showing the state of a stream of ions generated from the projection 36*a*. FIG. 5A shows the state of a stream of ions generated from the projection 36*a* as viewed from the widthwise direction of the projection 36*a* (a direction indicated by an arrow B1 shown in FIGS. 3A to 3C). FIG. 5B shows the state of a stream of ions generated from the projection 36*a* as viewed from the thicknesswise direction of the projection 36*a* (a direction indicated by an arrow B2 shown in FIGS. 3A to 3C). FIG. 5C shows the state of a stream of ions generated from the projection 36*a* as viewed from the opening of the shield case 34. Arrows shown in FIGS. 5A and 5B indicate how a stream of ions is to spread out. In FIG. 5C, an elliptic figure indicated by a chain double-dashed line represents a demarcation of a stream of ions generated from each of the projection 36*a*.

As shown in FIG. 5A, a stream of ions is less likely to spread out in the thicknesswise direction of the projection 36*a*, because the projections 36*a* standing at high potential are arranged adjacent each other. In contrast, as shown in FIG. 5B, in the widthwise direction of the projection 36*a*, a stream of ions travels toward the shield case 34 standing at low potential and is therefore allowed to spread easily out. Accordingly, as shown in FIG. 5C, a demarcation I of a stream of ions generated from each of the projections 36*a* takes on the form of an ellipse, the major axis of which is deflected obliquely with respect to the direction of arrangement of the projections 36*a*. Thus, as illustrated hereinbelow, the charging uniformity of an object to be charged can be improved.

Figure 6A:
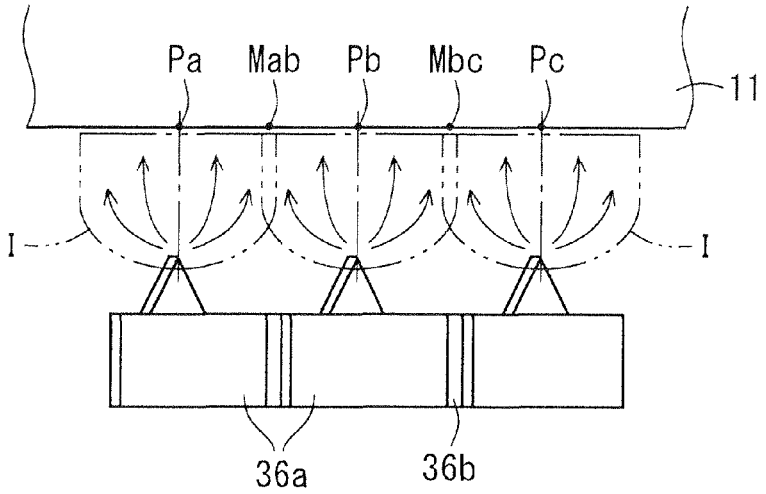
FIGS. 6A to 6C are views for explaining the effect of obliquely deflected ion streams to improve charging uniformity of an object to be charged.
Figure 6B:
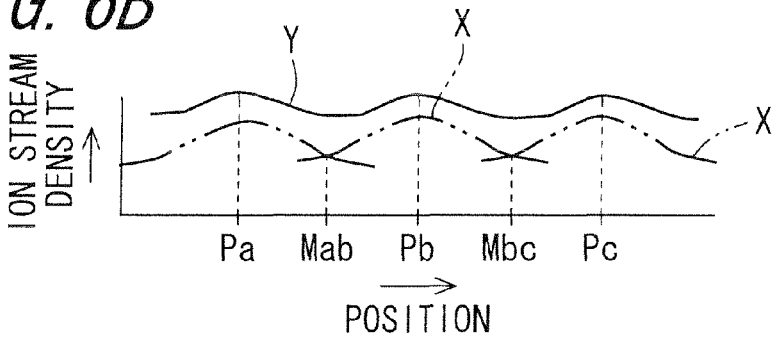
Figure 6C:
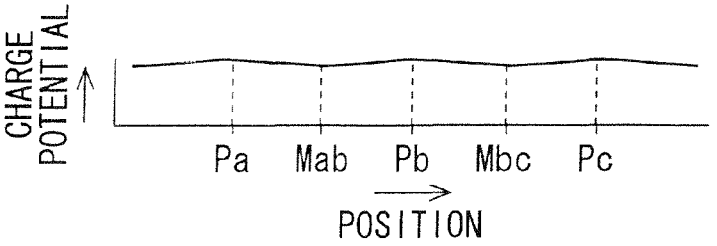

FIGS. 6A to 6C are views for explaining the effect of obliquely deflected ion streams to improve the charging uniformity of an object to be charged. FIG. 6A shows the state of a stream of ions generated from the projection 36*a* as viewed from the widthwise direction of the shield case 34. As shown in FIG. 6A, looking at streams of ions from the widthwise direction of the shield case 34, it will be understood that the demarcations I of the ion streams generated from the projections 36*a* that are adjacent to each other in the lengthwise direction of the shield case 34 overlap each other.

FIG. 6B is a graph showing ion stream density as observed at a position on the photoreceptor drum 11 opposed to the projection 36*a* during corona discharge effected in the charging device 12. In the graph shown in FIG. 6B, the axis of ordinate represents ion stream density and the axis of abscissa represents position on the photoreceptor drum 11 in its lengthwise direction. Moreover, as to the axis of abscissa, $P_a$, $P_b$, and $P_c$ each represent a position on the photoreceptor drum 11 opposed to the projection 36*a*, and $M_{ab}$ and $M_{bc}$ represent a midway point between $P_a$ and $P_b$ and a midway point between $P_b$ and $P_c$, respectively. A chain double-dashed line X represents a distribution of ion stream density as observed when the projections 36*a* are caused to generate a stream of ions on an individual basis. A solid line Y represents a distribution of ion stream density as observed when all of the projections 36*a* are caused to generate a stream of ions. This ion stream density distribution is equivalent to an ion stream distribution as observed in an actual charging process.

As shown in FIG. 6B, it will be understood that, in contrast to the case of causing the projections 36*a* to generate a stream of ions on an individual basis, in the case of causing all of the projections 36*a* to generate a stream of ions, no significant decrease in ion stream density occurs in the vicinity of the positions $M_{ab}$ and $M_{bc}$ each opposed to a point located midway between the projections 36*a*, and thus the level of ion stream density in this region is substantially the same as the level of ion stream density in the positions $P_a$, $P_b$, and $P_c$ each opposed to the projection 36*a*. Accordingly, the ion stream density can be rendered uniform throughout the length of the photoreceptor drum 11.

FIG. 6C is a graph showing the charged potential of the photoreceptor drum 11 in its lengthwise direction as observed when effecting corona discharge by the charging device 12 while rotatably driving the photoreceptor drum 11. In the graph shown in FIG. 6C, the axis of ordinate represents charged potential and the axis of abscissa represents position on the photoreceptor drum 11 in its lengthwise direction. Moreover, as to the axis of abscissa, $P_a$, $P_b$, and $P_c$ each represent a position on the photoreceptor drum 11 opposed to the projection 36*a*, and $M_{ab}$ and $M_{bc}$ represent a midway point between $P_a$ and $P_b$ and a midway point between $P_b$ and $P_c$, respectively.

As shown in FIG. 6C, the charged potential of the photoreceptor drum 11 could be rendered uniform. The difference between the maximum value and the minimum value in respect of the charged potential of the photoreceptor drum 11 was as small as a few volts. It has thus been found that the charging device 12 is capable of improving the charging uniformity of an object to be charged.

Thus, in the charging device 12, since the discharge electrode 36 is so constituted that the widthwise direction of the projection 36*a* is inclined at a predetermined angle with respect to the first imaginary plane including the arrangement direction C of the projections 36*a* on the second imaginary plane which includes the arrangement direction C and is perpendicular to the first imaginary plane, it follows that a stream of ions generated from each of the projections 36*a* is deflected obliquely with respect to the arrangement direction C of the projections 36*a*. Correspondingly, an ion-stream demarcated portion (a portion with decreased ion stream density) resulting from the repulsion of the ion streams generated from the adjacent projections 36*a*, respectively, are also deflected obliquely. Hence, the distribution of ion stream density is rendered uniform in the arrangement direction C of the projections 36*a*.

Moreover, when an object to be charged, such as the photoreceptor drum 11, is moved relative to the widthwise direction of the shield case 34, it never occurs that the direction of movement of the object to be charged and the portion with decreased ion stream density come into line with each other. Accordingly, even if the object to be charged is moved relative to the widthwise direction of the shield case 34, the ion stream density on the object to be charged will never become non-uniform. It will thus be seen that the charging device 12 pursuant to the invention is capable of improving the charging uniformity of an object to be charged.

The image forming apparatus 1 equipped with such a charging device 12 is able to form high-quality images by operating the charging device 12 in a manner to charge the photoreceptor drum 11. Moreover, the image forming apparatus 1 is able to reduce the amount of ozone generation entailed by charging operation. Further, since the charging device 12 achieves improvement in charging uniformity with a simple structure, it is possible to make the image forming apparatus 1 compact in size at low cost.

It is noted that, in the charging device 12, although the projections 36*a* may be configured slightly differently from one another in terms of form and inclination angle so long as they are constituted to deflect a stream of ions obliquely for improvement in the charging uniformity of an object to be charged, it is preferable that the projections 36*a* are constituted to have the same form and the same inclination angle. By doing so, the repulsion of the ion streams generated from the projections 36*a* can be suppressed, wherefore the charging uniformity of an object to be charged can be enhanced even further in the direction of arrangement of the projections 36*a*.

Moreover, by way of another embodiment of the charging device pursuant to the invention, instead of the discharge electrode 36, it is possible to provide a discharge electrode in which a plurality of projections are arranged separately from each other. Just as in the case of the present embodiment and another embodiment, a discharge electrode having a plurality of projections affords the advantage of minimizing the likelihood of ozone generation because of the limitations of the point of discharge for causing corona discharge.

In the charging device 12, as has already been described, it is desirable to use the bending members 40*a* and 40*b* as the holding portion 37. This makes it possible to keep the inclination angle of the projection 36*a* with high accuracy and thereby maintain the charging uniformity of an object to be charged in the direction of arrangement of the projections 36*a*. Moreover, the use of the same component both as the holding portion 37 and the bending member 40*a*, 40*b* helps reduce the manufacturing cost.

In addition to being used as an apparatus for charging the photoreceptor drum 11, the charging device 12 can be used for other purposes. For example, the pre-primary transfer charging portion 16 and the pre-secondary transfer charging portion 32, each of which is another charging device employed in the image forming apparatus 1, are apparatuses for charging an object to be charged in a moving state. Accordingly, the charging device 12 can preferably be applied to the pre-primary transfer charging portion 16 and the pre-secondary transfer charging portion 32.

As has already been described, the charging uniformity enhancing effect of the charging device 12 is brought about by the projections 36*a* arranged with inclination in the discharge electrode 36. Therefore, in the charging device pursuant to the invention, a discharge electrode configured differently from the discharge electrode 36 can be disposed instead of the discharge electrode 36 so long as it has projections and the projections are arranged with inclination as described previously. The following is an explanation about a discharge electrode 41 shown in FIGS. 7A to 7C that can be mounted instead of the discharge electrode 36.

Figure 7A:
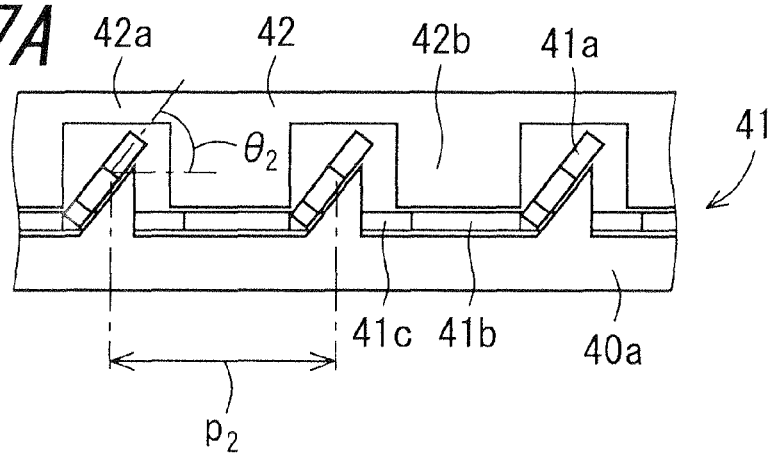
FIGS. 7A to 7C are views for explaining a discharge electrode.
Figure 7B:
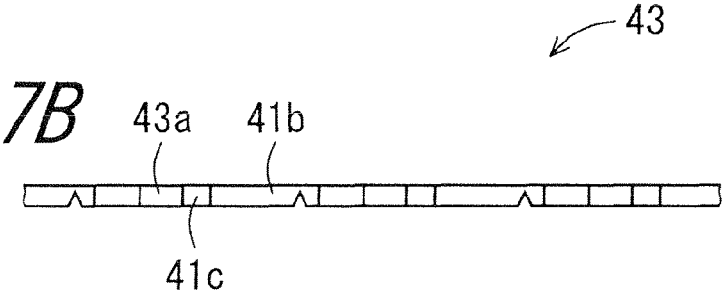
Figure 7C:
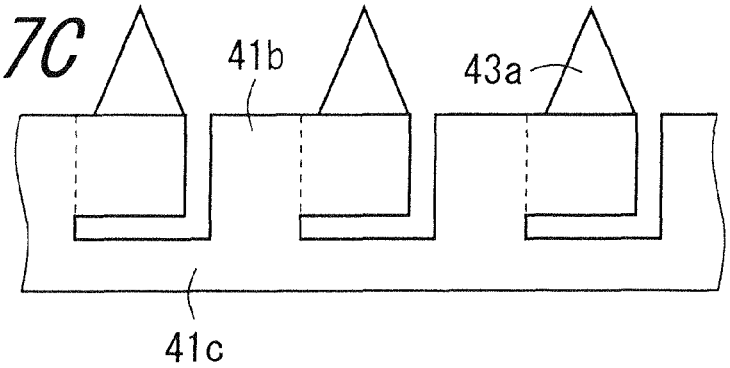
Figure 8A:
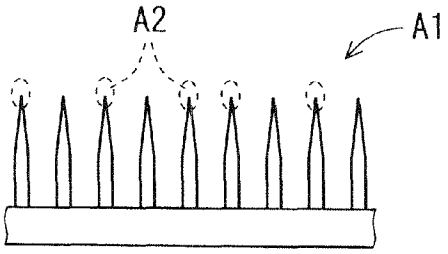
FIG. 8A PRIOR ART
FIGS. 8A to 8D are views showing a relationship between a projection pitch in a discharge electrode and charging uniformity
Figure 8B:
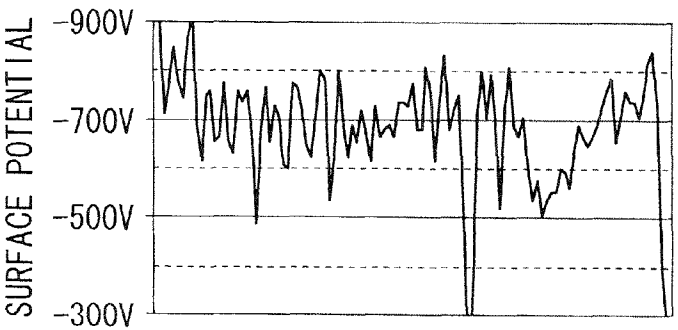
FIG. 8B PRIOR ART
Figure 8C:
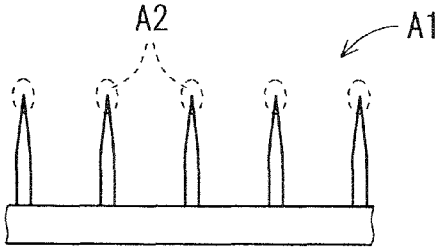
FIG. 8C PRIOR ART
Figure 8D:
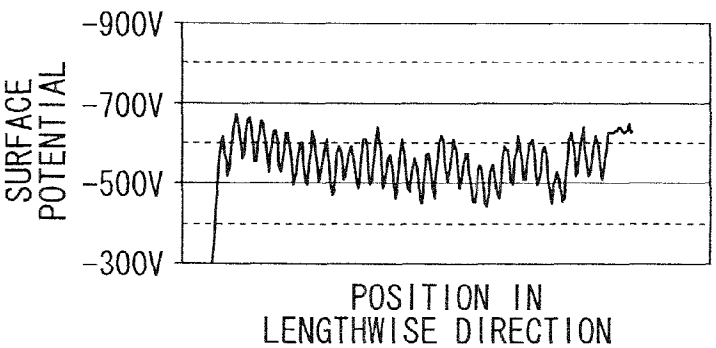
FIG. 8D PRIOR ART
Figure 9A:
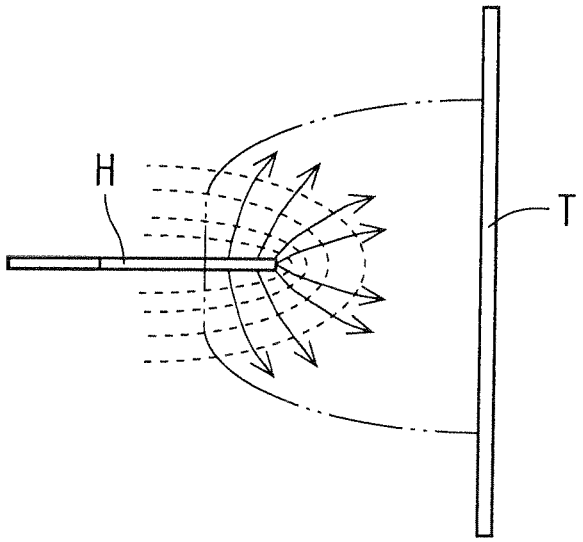
FIG. 9A PRIOR ART
FIGS. 9A to 9C are views showing how electric discharge is to be effected in a conventional corona discharge device.
Figure 9B:
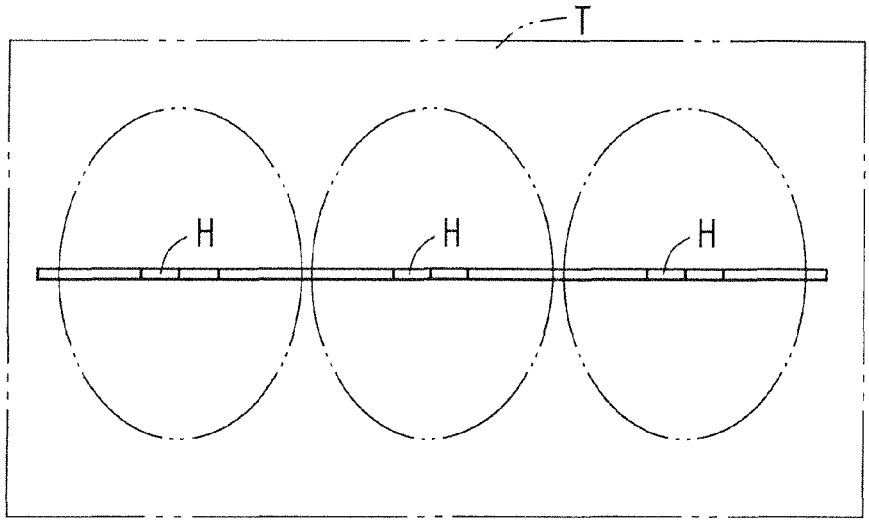
FIG. 9B PRIOR ART
Figure 9C:
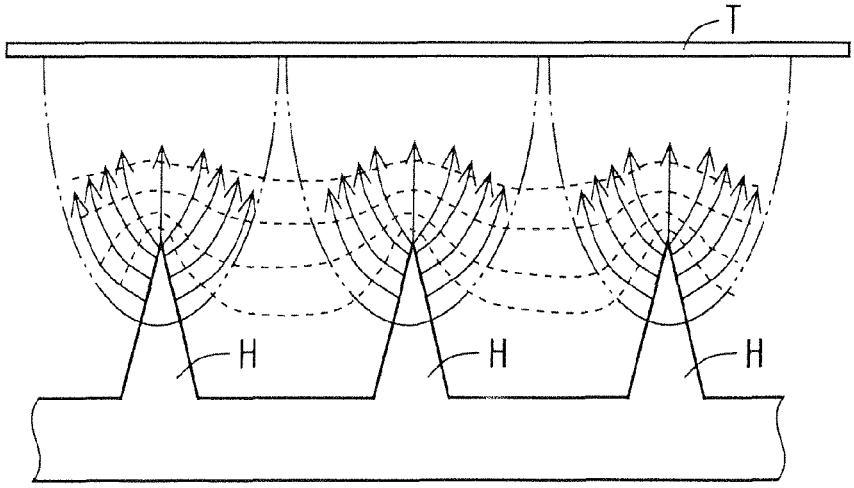
FIG. 9C PRIOR ART
Figure 10:
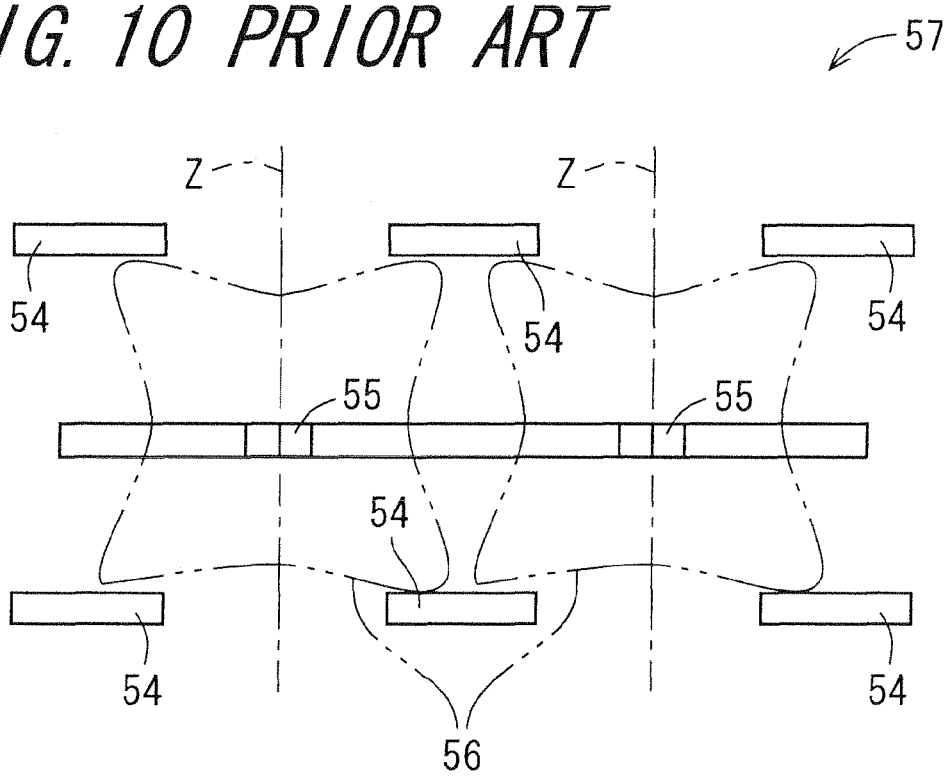
FIG. 10 PRIOR ART
FIG. 10 is a schematic diagram showing the charging device as viewed from a surface of an object to be charged.
Figure 11:
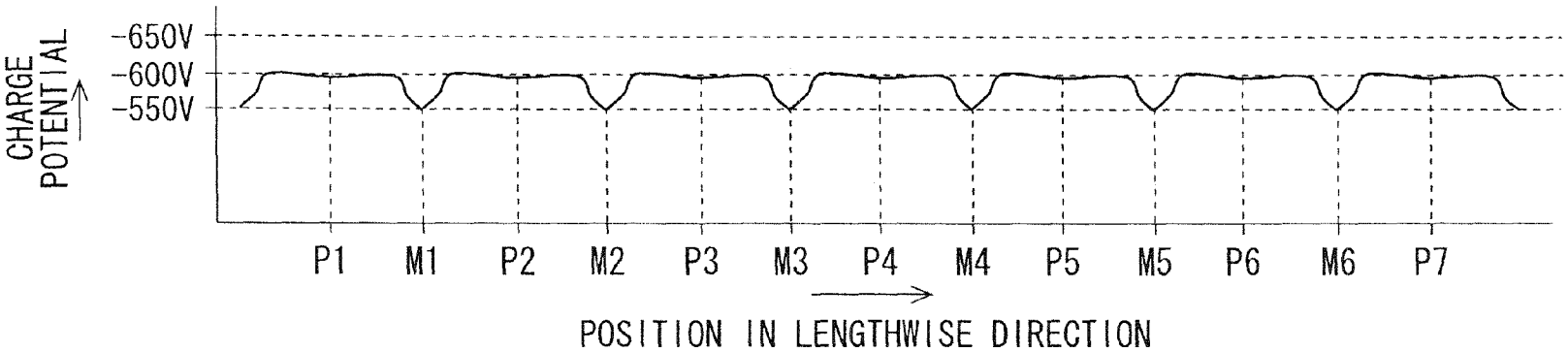
FIG. 11 PRIOR ART
FIG. 11 is a graph showing a distribution of charged potentials at an object to be charged in the case of using the charging device.

FIGS. 7A to 7C are views for explaining the discharge electrode 41. FIG. 7A shows the discharge electrode 41 in a state of being retained by a holding portion 42 and a bending member 40*a*. The discharge electrode 41, as well as the holding portion 42 and the bending member 40*a* for retaining the discharge electrode 41, can be provided in the charging device 12, instead of the discharge electrode 36 and the holding portion 37.

The discharge electrode 41 includes a plurality of projections 41*a*, a plurality of connecting portions 41*b*, and a base portion 41*c*. The discharge electrode 41 is identical in material with the discharge electrode 36. The base portion 41*c* is a rectangular flat plate extending in the lengthwise direction of the shield case 34. The connecting portions 41*b* are rectangular flat plates that are connected to widthwise one end of the base portion 41*c* and are arranged at the same interval as the pitch of the projections 41*a* in the lengthwise direction of the shield case 34. The connecting portion 41*b* has a width falling in the range of from 1 mm to 10 mm, and has a length falling in the range of from 2 mm to 10 mm in its protruding direction.

The projection 41*a* has its widthwise one end connected to the connecting portion 41*b* and has widthwise the other end made as a free end. The distance between the free end and the neighboring connecting portion 41*b* falls in the range approximately from 0.1 mm to 0.5 mm. The length of the part of connection between the projection 41*a* and the connecting portion 41*b* in the protruding direction is, depending upon the length of the connecting portion 41*b* in the same direction, preferably set to be substantially half the length of the connecting portion 41*b* in view of the strength of the discharge electrode 41. The form, a pitch $p_2$, and an inclination angle $\theta_2$ of the projections 41*a* are the same as the form, the pitch p, and the inclination angle θ, respectively, of the projections 36*a* of the discharge electrode 36.

The holding portion 42 is a comb-like member formed with concavities 42*a* and convexities 42*b* arranged in alternate order. When the discharge electrode 41 is retained by the holding portion 42 and the bending member 40*a*, the connecting portion 41*b* and the base portion 41*c* are pressed against the bending member 40*a* by the convexity 42*b* of the holding portion 42. At the same time, by the action of the serration of the bending member 40*a*, the projection 41*a* is retained while being surrounded by the concavity 42*a* of the holding portion 42.

The discharge electrode 41 is made of a plate-like material 43. FIG. 7B is a front view of the plate-like material 43. FIG. 7C is a bottom view of the plate-like material 43. The plate-like material 43 is a single plate-like material formed with to-form-projection portions 43*a*, which become the projections 41*a* through the bending of the plate-like material 43, the connecting portions 41*b*, and the base portion 41*c*. The plate-like material 43 is formed from a metal material having the shape of a rectangular flat plate by means of etching, press punching, or otherwise.

The plate-like material 43 has half-etching portions e3 that are created by performing half etching at one side of the plate-like material 43. The half-etching portion e3 becomes the part of connection between the to-form-projection portion 43*a* and the connecting portion 41*b*. The half-etching portion e3 is a groove formed by means of etching. The half-etching portion e3 is so formed that the depth of the groove falls in the range of from 0.02 mm to 0.05 mm in the direction of thickness of the plate-like material 43.

The discharge electrode 41 can be formed by bending the plate-like material 43 with use of the bending member 40*a* and the holding portion 42. That is, the holding portion 42 can be used as a bending member. In this way, the discharge electrode 41 is formed simply by bending a single plate-like material 43. This makes it possible to achieve formation of the discharge electrode 41 with ease and at low cost. Moreover, as described previously, the discharge electrode 41 is formed by bending the plate-like material 43 in such a manner that widthwise one end of the projection 41*a* is separated from the plate-like material 43 and widthwise the other end thereof is kept connected with the plate-like material 43. This helps reduce the amount of the plate-like material 43 to be used.

Moreover, in a case where the projections 41*a* are constituted to have the same inclination angle $\theta_2$, by forming the to-form-projection portions 43*a* at a uniform pitch, the projections 41*a* can be formed at a uniform pitch $p_2$ correspondingly. This offers the advantage that the pitch $p_2$ can be controlled with a higher degree of accuracy. Further, the step of bending the plate-like material 43 involves only bending of each of the to-form-projection portions 43*a* in one direction, with the consequent advantages of simplicity of operation and enhancement in operation accuracy.

Next, the charging device 12 equipped with the discharge electrode 41 instead of the discharge electrode 36 has been subjected to various changes in terms of the width W of the shield case 34, the pitch $p_2$ of the projections 41*a*, and the inclination angle $\theta_2$, and the charged potential of the photoreceptor drum 11 in its lengthwise direction was measured for each of different cases to evaluate charging uniformity. The measurement of the charged potential of the photoreceptor drum 11 was conducted by using a measurement system as shown in FIG. 2. Adjustments to the inclination angle $\theta_2$ were made by varying the form of the bending member 40*a*.

The charging uniformity evaluations have been conducted on the basis of the presence or absence of charged potential variation that appears as unevenness in density on an image as a standard for judgment. A case rated "Excellent" shows that there is no charged potential variation and thus the apparatus is in an excellent condition. A case rated "Good" shows that there is little charged potential variation and thus the apparatus is in a good condition. A case rated "Not bad" shows that there is a little charged potential variation and thus the apparatus may pose some problem in practical use. A case rated "Poor" shows that there is considerable charged potential variation and thus the apparatus is in a very poor condition. The charged potential variation was measured under the following measurement conditions.

<Measurement Conditions>

Photoreceptor (Negatively-charged type OPC)

Outside diameter .PHI.: 30 mm

Circumferential velocity: 220 mm/s

Charging device

Set value for discharge current: −300 μA

Set potential: −650 V (based on grid bias adjustment)

Charge eliminating light: present

Potential measurement system

Surface potential measuring equipment: Model 1344 manufactured by TREK INC.

Distance between Photoreceptor and Probe: 1 mm

Probe scanning speed: 10 mm/s

The following is the relationship between the standard for charging uniformity evaluation and the amount of variation in charged potential.

Excellent: Charged potential variation is less than or equal to 30 V

Good: Charged potential variation is greater than 30 V but less than or equal to 50 V Not bad: Charged potential variation is greater than 50 V but less than or equal to 100 V Poor: Charged potential variation is greater than 100 V Listed in Table 1 are the values of the case width W, the pitch $p_2$, the inclination angle $\theta_2$, and W/tan ($\theta_2$), and the results of charging uniformity evaluations.

TABLE 1

| Case width W (mm) | Inclination angle $\theta_2$ (°) | Pitch $p_2$ (mm) | W/tan ($\theta_2$) (mm) | Charging uniformity |
|---|---|---|---|---|
| 14.0 | 15.0 | 4.0 | 52.2 | Good |
| | 30.0 | 4.0 | 24.2 | Excellent |
| | 45.0 | 4.0 | 14.0 | Excellent |
| | 60.0 | 4.0 | 8.1 | Excellent |
| | 75.0 | 4.0 | 3.8 | Not bad |
| | 15.0 | 8.0 | 52.2 | Good |
| | 30.0 | 8.0 | 24.2 | Excellent |
| | 45.0 | 8.0 | 14.0 | Excellent |
| | 60.0 | 8.0 | 8.1 | Good |
| | 75.0 | 8.0 | 3.8 | Poor |
| | 15.0 | 12.0 | 52.2 | Good |
| | 30.0 | 12.0 | 24.2 | Excellent |
| | 45.0 | 12.0 | 14.0 | Excellent |
| | 60.0 | 12.0 | 8.1 | Not bad |
| | 75.0 | 12.0 | 3.8 | Poor |
| 24.0 | 15.0 | 4.0 | 89.8 | Good |
| | 30.0 | 4.0 | 41.6 | Excellent |
| | 45.0 | 4.0 | 24.0 | Excellent |
| | 60.0 | 4.0 | 13.9 | Excellent |
| | 75.0 | 4.0 | 6.4 | Good |
| | 15.0 | 8.0 | 89.8 | Good |
| | 30.0 | 8.0 | 41.6 | Excellent |

TABLE 1-continued

| Case width W (mm) | Inclination angle $\theta_2$ (°) | Pitch $p_2$ (mm) | W/tan ($\theta_2$) (mm) | Charging uniformity |
|---|---|---|---|---|
| | 45.0 | 8.0 | 24.0 | Excellent |
| | 60.0 | 8.0 | 13.9 | Excellent |
| | 75.0 | 8.0 | 6.4 | Not bad |
| | 15.0 | 12.0 | 89.8 | Good |
| | 30.0 | 12.0 | 41.6 | Excellent |
| | 45.0 | 12.0 | 24.0 | Excellent |
| | 60.0 | 12.0 | 13.9 | Good |
| | 75.0 | 12.0 | 6.4 | Poor |

It will be understood from Table 1 that, when the relationship among the inclination angle $\theta_2$ (°), the case width W (mm), and the pitch $p_2$ (mm) fulfills the condition of $p_2<W/\tan(\theta_2)$, then satisfactory charging uniformity can be attained. It will also be understood that, when the inclination angle $\theta_2$ is greater than or equal to 30°, then excellent charging uniformity can be attained.

Based on the above results, it can be considered that a stream of ions generated from the projection 41*a* spreads over the top surface and the bottom surface of the shield case 34 while being deflected obliquely. This is because, in such a case, in order for the ion-stream demarcated portions to overlap each other when the ion streams are viewed from the widthwise direction of the shield case 34, it is essential that the sum of the length of a stream of ions traveling from one projection 41*a* toward the top surface of the shield case 34 in the direction of arrangement of the projections 41*a* and the length of a stream of ions traveling from the other adjacent projection 41*a* toward the bottom surface of the shield case 34 in the direction of arrangement of the projections 41*a* should be greater than the pitch p.

In the present embodiment, since the projections 41*a* are so formed as to have the same inclination angle $\theta_2$, it follows that the length of a stream of ions traveling from one projection 41*a* toward the top surface of the shield case 34 in the direction of arrangement of the projections 41*a* is given as: $W/\{2\tan(\theta_2)\}$, and the length of a stream of ions traveling from the other adjacent projection 41*a* toward the bottom surface of the shield case 34 in the direction of arrangement of the projections 41*a* is given as: $W/\{2\tan(\theta_2)\}$, too. Accordingly, the sum of those two values is given as: $W/\tan(\theta_2)$, wherefore the above relational expression: $p_2<W/\tan(\theta_2)$ holds.

It will be understood from the foregoing consideration that, so long as the projections are inclined in the same direction, even if they have different inclination angles, it is possible to make use the advantageous effect of the invention. That is, in the case where the projections are inclined in the same direction, assuming that given two adjacent projections have an inclination angle $\alpha$ and an inclination angle $\beta$, respectively, then the pitch $p_2$ and the inclination angles of the projections are so determined that the condition of $p_2<W/\{2\tan(\alpha)\}$ $W/\{2\tan(\beta)\}$ can be fulfilled. This makes it possible to adjust a stream of ions to deflect in an optimum condition, and thereby achieve improvement in charging uniformity.

Moreover, it can be considered that, by setting the inclination angle of the projection 41*a* at or above 30°, it is possible to allow a stream of ions with relatively high density to spread over a midway area between one projection 41*a* and the other adjacent projection 41*a*, and thereby achieve further improvement in charging uniformity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging device comprising:

a shield case having an opening;

a discharge electrode disposed in an interior space of the shield case, having a plurality of projections aligned in one direction from which a stream of ions is generated, the plurality of projections each being so disposed that a width direction thereof makes a predetermined angle with a direction of arrangement of the plurality of projections, in order that streams of ions generated from the projections that are adjacent to each other in a lengthwise direction of the shield case can overlap each other when viewed in a widthwise direction of the shield case, the plurality of projections all being arranged substantially parallel to one another; and wherein the discharge electrode is so constituted that a condition of $p<W/\{2\tan(\alpha)\}+W/\{2\tan(\beta)\}$ is fulfilled, wherein W denotes a width of the shield case, $\alpha$ and $\beta$ denote predetermined angles of given two projections arranged adjacent to each other in a lengthwise direction of the shield case are, respectively, and p denotes a pitch of tip ends of the two projections.

2. The charging device of claim 1, wherein the discharge electrode is so constituted that predetermined angles of all of the projections of the discharge electrode are the same.

3. The charging device of claim 1, further comprising a holding portion for retaining the discharge electrode in the interior space of the shield case, wherein the discharge electrode is constructed by bending a plate-like material, and the holding portion serves as a bending member which is used to form the discharge electrode by bending the plate-like material.

4. An image forming apparatus comprising:

an image bearing member for bearing an electrostatic latent image thereon; and the charging device of claim 1, the image bearing member being charged by the charging device.

5. A discharge electrode forming method for forming a discharge electrode which is provided in the charging device of claim 1 by bending a single sheet of a plate-like material.

6. The method of claim 5, wherein the plate-like material is bent in such a manner that widthwise one end of the respective projections of the discharge electrode is separated from the plate-like material, whereas widthwise the other end thereof is kept connected with the plate-like material.

7. The method of claim 5, wherein the bending step results in the predetermined angle being between 15° and 75°.

8. The method of claim 5, wherein the bending step results in the predetermined angle being approximately 45°.

9. The charging device of claim 1, wherein the predetermined angle is between 15° and 75°.

10. The charging device of claim 1, wherein the predetermined angle is approximately 45°.

* * * * *